US010694880B2

(12) United States Patent
Mullet et al.

(10) Patent No.: US 10,694,880 B2
(45) Date of Patent: Jun. 30, 2020

(54) VALANCE SYSTEM FOR WINDOW COVERINGS

(71) Applicant: Current Products Corp., Pensacola, FL (US)

(72) Inventors: Willis J. Mullet, Gulf Breeze, FL (US); Daniel T. Matthews, Pensacola, IA (US); Richard Scott Hand, Pace, FL (US); Harry Edward Asbury, Holt, FL (US)

(73) Assignee: CURRENT PRODUCTS CORP., Pensacola, FL (US)

( * ) Notice: Subject to any disclaimer, the term of this patent is extended or adjusted under 35 U.S.C. 154(b) by 426 days.

(21) Appl. No.: 15/413,973

(22) Filed: Jan. 24, 2017

(65) Prior Publication Data

US 2017/0208980 A1 Jul. 27, 2017

Related U.S. Application Data

(60) Provisional application No. 62/286,689, filed on Jan. 25, 2016.

(51) Int. Cl.

| | |
|---|---|
| ***A47H 2/00*** | (2006.01) |
| ***A47H 1/04*** | (2006.01) |
| ***A47H 1/144*** | (2006.01) |

(52) U.S. Cl.

CPC ..... *A47H 2/00* (2013.01); *A47H 1/04* (2013.01); *A47H 1/144* (2013.01); *A47H 2001/047* (2013.01)

(58) Field of Classification Search

CPC . A47H 2/00; A47H 1/04; A47H 1/144; A47H 1/14; A47H 2001/047; E06B 9/17; E06B 9/17007; E06B 9/17015; E06B 9/17023; E06B 9/323

See application file for complete search history.

(56) References Cited

U.S. PATENT DOCUMENTS

| | | | | |
|---|---|---|---|---|
| 2,277,240 A * | 3/1942 | Lowry | E04F 10/0685 | 160/38 |
| 2,531,822 A * | 11/1950 | Moeller | A47H 2/00 | 160/335 |
| 2,553,869 A * | 5/1951 | Purcell | A47H 2/00 | 160/38 |
| 2,638,162 A * | 5/1953 | Heitlinger | A47H 2/00 | 160/368.1 |
| 2,653,656 A * | 9/1953 | Kuebler | A47H 1/04 | 16/87.6 R |

(Continued)

*Primary Examiner* — Johnnie A. Shablack

(74) *Attorney, Agent, or Firm* — Christopher A. Proskey; BrownWinick Law Firm

(57) ABSTRACT

A valance system for a window covering that can be folded and placed within the same shipping box as a wall bracket, top bracket and track sections. The valance extends a length between opposing ends and includes a clip feature that extends out from its rearward side. The clip feature is generally C-shaped or U-shaped when viewed from the side and includes a plurality of friction members in its exterior surface. The valance is covered with a covering material. An end cap having a hinge area that facilitates bending of the end cap is connected to the ends of the valance by connection of a tongue of the end cap to a slot of the valance. The clip feature is sized and shaped to frictionally fit within and be installed within a socket of a top bracket without any tools.

14 Claims, 36 Drawing Sheets

(56) References Cited

U.S. PATENT DOCUMENTS 2,706,521 A * 4/1955 Nelson ..... A47H 1/142 160/38
2,862,549 A * 12/1958 Robbins ..... A47H 2/00 160/38
2,894,571 A * 7/1959 Toti ..... A47H 2/00 160/38
2,998,062 A * 8/1961 Bixby ..... A47H 2/02 160/39
3,378,057 A * 4/1968 Synck ..... A47H 2/00 160/348
3,435,876 A * 4/1969 Toti ..... A47H 1/104 160/38
3,463,217 A * 8/1969 Assael ..... A47H 2/00 160/39
3,574,887 A * 4/1971 Schindlauer ..... A47H 2/00 16/95 D
3,788,376 A * 1/1974 Mednick ..... A47H 1/142 160/126
3,927,437 A * 12/1975 Ford ..... A47H 1/144 16/94 R
4,079,770 A * 3/1978 Woodle ..... A47H 2/02 160/19
4,114,233 A * 9/1978 Hamilton ..... A47H 1/04 16/95 R
4,120,474 A * 10/1978 Hurley ..... A47H 1/124 16/93 D
4,154,421 A * 5/1979 Suvitie ..... A47H 1/00 248/327
4,222,156 A * 9/1980 Anderle ..... E06B 9/323 160/38
4,254,813 A * 3/1981 Vecchiarelli ..... A47H 2/00 160/19
4,254,814 A * 3/1981 Vecchiarelli ..... E06B 9/323 160/19
4,341,254 A * 7/1982 Schaller ..... E06B 9/327 160/172 R
4,352,433 A * 10/1982 Ford ..... A47H 1/122 211/105.1
4,354,300 A * 10/1982 Anderle ..... E06B 9/323 160/38
4,384,605 A * 5/1983 Schaeffer ..... E06B 9/38 160/178.1 R
4,399,856 A * 8/1983 Anderson ..... A47H 1/104 160/39
4,662,421 A * 5/1987 Basmadji ..... E06B 9/323 16/94 D
4,828,002 A * 5/1989 Ashby ..... E06B 9/323 160/38
4,840,216 A * 6/1989 John ..... E06B 9/323 16/87.4 R
4,890,808 A * 1/1990 Ford ..... A47H 2/00 211/103
4,921,031 A * 5/1990 Wagner ..... A47H 2/00 160/178.1 R
4,935,988 A * 6/1990 Ford ..... A47H 1/02 16/87.4 R
4,955,419 A * 9/1990 Morris ..... E06B 9/323 160/178.1 R
4,957,255 A * 9/1990 John ..... E06B 9/323 160/38
5,012,850 A * 5/1991 Schrader ..... A47H 2/00 160/178.1 R
5,018,626 A * 5/1991 Johnson ..... A47H 1/142 16/94 R
5,024,338 A * 6/1991 Austin ..... A47H 1/02 211/105.1
5,033,525 A * 7/1991 Paeselt ..... A47H 2/00 160/19
5,039,049 A * 8/1991 Niemi ..... A47H 1/022 160/39
5,042,548 A * 8/1991 Attal ..... A47H 2/00 160/21
5,054,535 A * 10/1991 Rozon ..... E06B 9/323 160/173 V
5,074,350 A * 12/1991 Carter ..... E06B 9/323 16/94 R
5,112,157 A * 5/1992 Haarer ..... A47H 1/02 211/105.1
5,219,013 A * 6/1993 Rozon ..... A47H 2/00 160/178.1 V
5,232,039 A * 8/1993 Shapiro ..... A47H 2/00 160/330
5,259,687 A * 11/1993 John ..... A47H 2/00 160/38
5,330,821 A * 7/1994 Lo ..... A47H 2/02 16/94 R
5,335,709 A * 8/1994 Borzi ..... A47H 2/02 160/39
5,417,271 A * 5/1995 Fenley ..... E06B 9/303 160/38
5,480,040 A * 1/1996 Ryan ..... A47H 2/00 211/105.1
5,515,901 A * 5/1996 Hall ..... E05D 15/264 160/206
5,520,234 A * 5/1996 Simmons ..... A47H 2/00 160/19
5,598,880 A * 2/1997 Cross ..... A47H 2/00 160/348
5,636,674 A * 6/1997 Benthin ..... A47H 2/00 160/38
5,655,588 A * 8/1997 Lamont ..... A47H 2/00 160/38
5,890,527 A * 4/1999 Smiley ..... A47H 2/02 160/39
5,927,362 A * 7/1999 Smiley ..... A47H 2/02 160/378
5,944,084 A * 8/1999 Cadorette ..... A47H 2/00 160/19
5,967,213 A * 10/1999 Smiley ..... A47H 2/02 160/378
6,094,796 A * 8/2000 Biro ..... A47H 2/00 29/412
6,111,694 A * 8/2000 Shopp ..... G03B 21/58 160/23.1
6,202,967 B1 * 3/2001 Fraczek ..... A47H 23/01 160/166.1
6,234,233 B1 * 5/2001 Biro ..... A47H 2/00 160/38
6,431,247 B1 * 8/2002 Harrison, Jr. ..... E06B 9/323 160/168.1 R
6,516,957 B1 * 2/2003 Harkinson ..... A47H 1/02 211/105.1
6,532,625 B1 * 3/2003 Stone ..... A47H 1/06 16/87.4 R
6,585,208 B1 * 7/2003 Fraser ..... A47H 1/10 248/251
6,601,809 B1 * 8/2003 Gebrara ..... G09F 7/18 160/38
6,659,154 B2 * 12/2003 Bergeron ..... A47H 2/00 160/178.1 V
6,672,359 B2 * 1/2004 Morris ..... A47H 2/00 160/19
6,712,115 B2 * 3/2004 Judkins ..... E06B 9/264 160/178.1 R
6,732,783 B2 * 5/2004 Bouldin ..... A47H 23/04 160/348
6,877,548 B1 * 4/2005 Chartier ..... E06B 9/36 160/10
7,063,121 B2 * 6/2006 Zorbas ..... A47H 2/00 160/38
7,134,469 B2 * 11/2006 Drew ..... E06B 9/42 160/38
7,134,473 B2 * 11/2006 Lukos ..... E06B 9/50 160/242
7,216,686 B2 * 5/2007 Repp ..... A47H 2/00 160/38
7,513,290 B2 * 4/2009 Repp ..... A47H 2/00 160/38

(56) References Cited

U.S. PATENT DOCUMENTS 8,069,898 B1 * 12/2011 Mullet ..... E06B 9/42 160/19
8,480,048 B2 * 7/2013 Krantz-Lilienthal ... F16B 2/245 160/23.1
9,115,532 B1 * 8/2015 Sherman ..... E06B 1/34
9,119,497 B2 * 9/2015 Sanchuk ..... A47H 1/142
9,238,938 B2 * 1/2016 Sherman ..... E06B 1/34
9,266,639 B2 * 2/2016 Cluett ..... B65D 5/42
9,476,255 B2 * 10/2016 Nurre ..... E06B 9/42
9,498,079 B2 * 11/2016 Sanchuk ..... A47H 1/142
9,617,785 B2 * 4/2017 Chou ..... E06B 9/24
9,822,939 B2 * 11/2017 Krause ..... F21S 9/032
10,174,549 B1 * 1/2019 Chou ..... E06B 9/322
2002/0127368 A1 * 9/2002 Richardson ..... B44C 1/28 428/99
2003/0010174 A1 * 1/2003 Biro ..... A47H 2/00 83/581
2007/0017165 A1 * 1/2007 Richardson ..... B44C 1/28 52/96
2008/0092470 A1 * 4/2008 Jackson ..... E04F 19/0436 52/288.1
2008/0230187 A1 * 9/2008 Caron ..... A47H 2/00 160/38
2011/0114809 A1 * 5/2011 Ng ..... E06B 9/323 248/309.1
2014/0262060 A1 * 9/2014 VanDervoort ..... A47H 2/00 160/38
2016/0137400 A1 * 5/2016 Cluett ..... B65D 5/42 53/410
2016/0340972 A1 * 11/2016 Chou ..... E06B 9/24
2017/0079459 A1 * 3/2017 Filko ..... A47H 1/122
2017/0208980 A1 * 7/2017 Mullet ..... A47H 2/00
2017/0321479 A1 * 11/2017 Roberts ..... E06B 9/52
2018/0328107 A1 * 11/2018 Stout ..... E06B 9/323
2019/0150650 A1 * 5/2019 Mullet ..... A47H 3/02

* cited by examiner

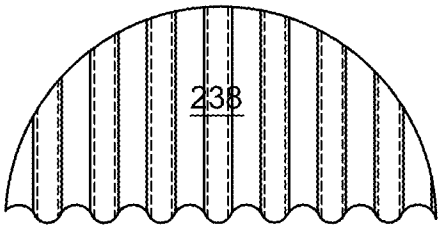
FIG. 14B
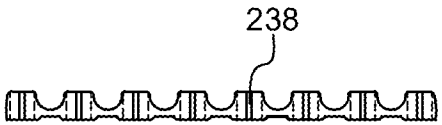
FIG. 14D
FIG. 14
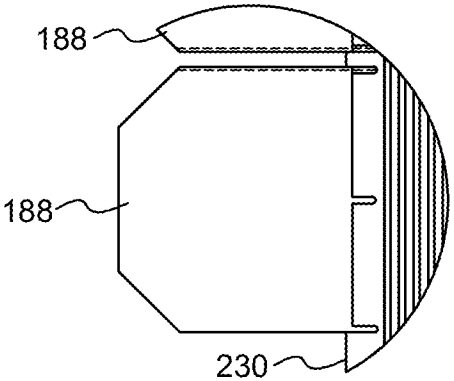
FIG. 14A
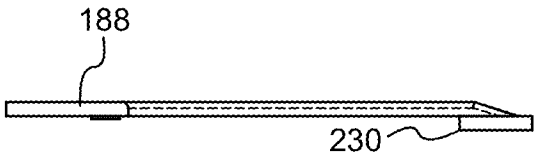
FIG. 14C
152

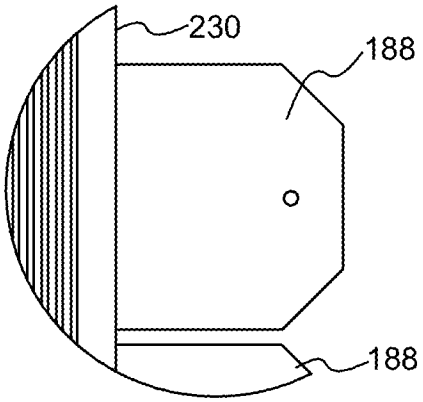
FIG. 15C
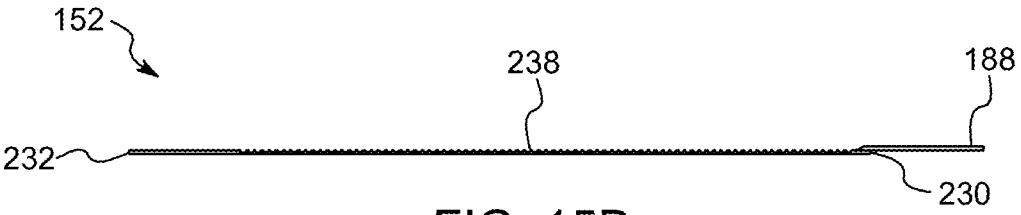
FIG. 15B
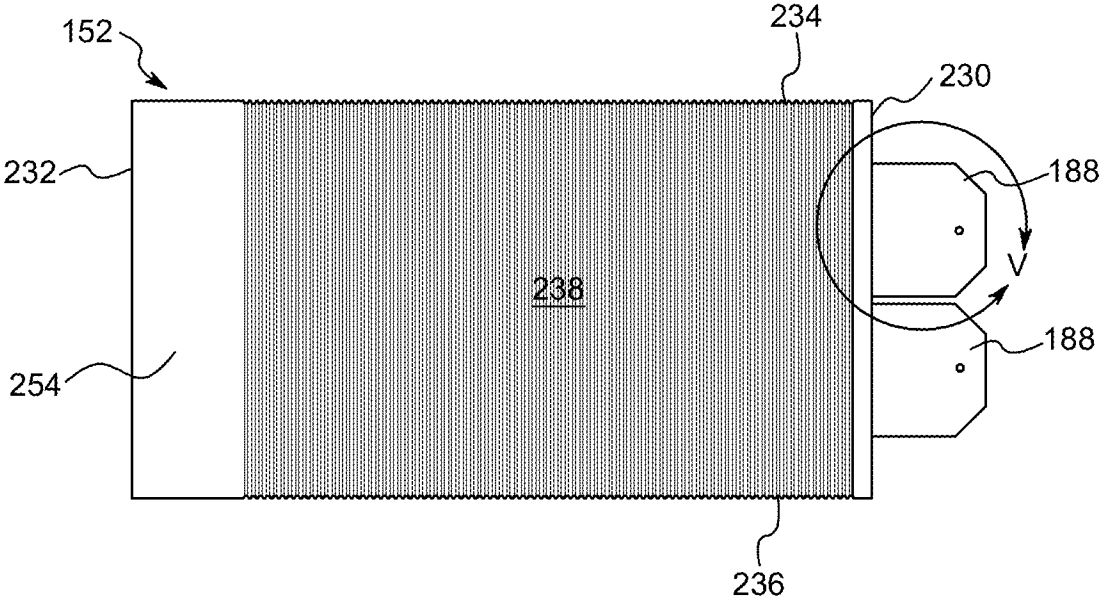
FIG. 15A
FIG. 15

VALANCE SYSTEM FOR WINDOW COVERINGS

CROSS-REFERENCE TO RELATED APPLICATION

This application claims priority from U.S. Patent and Trademark Office Provisional Application No. 62/286,689 filed Jan. 25, 2016.

FIELD OF THE INVENTION

This invention relates to window coverings. More specifically, this invention relates to a valance system for window coverings.

BACKGROUND OF THE INVENTION

Window coverings are frequently used to provide privacy and to limit the amount of light that is permitted to pass through a window and into a room. There are numerous types of window coverings known in the art. One form of window coverings, which are of particular interest to this application, are known as drapes (or drapery), curtains, vertical blinds, drapery tracks, or the like which hang from a track system or other structure positioned above a window. For purposes of simplicity, these window covering systems will be referred to draperies, drapery systems, or window coverings; however no limitation is to be implied and instead the teachings herein are applicable to any form of a window covering.

One problem with drapery systems is that the track system and bracketry that is used to hang and operate the shade material tends to have an unappealing appearance. As such, in many applications, users cover or hide the drapery track and bracketry behind a fascia or valance.

However, due to there being countless forms and designs of drapery systems, there is no standard or convenient method of installing a valance. As such, in many cases, users tend to custom fabricate their own fascia or valance out of plywood or other readily available materials. While effective, this process is extremely time consuming, labor intensive and many times it leads to a finished product that is less than optimal. In addition, custom fabricating a valance often produces a finished product that uses more materials than is necessary, is heavier than is necessary, is more complicated and difficult to install, and can provide a substantial safety hazard if installed improperly. In addition, removing and replacing these custom fabricated valances tends to suffer from the same disadvantages.

For the reasons stated above, and for other reasons stated below which will become apparent to those skilled in the art upon reading and understanding the specification, there is a need in the art for an improved valance system for window coverings.

Thus, it is a primary object of the invention to provide a valance system for window coverings that improves upon the state of the art.

Another object of the invention is to provide an improved valance system for window coverings that has a pleasing aesthetic appearance.

Yet another object of the invention is to provide an improved valance system for window coverings that is easy to install.

Another object of the invention is to provide an improved valance system for window coverings that is easy to remove.

Yet another object of the invention is to provide an improved valance system for window coverings that is easy to cover.

Another object of the invention is to provide an improved valance system for window coverings that is easy to ship.

Yet another object of the invention is to provide an improved valance system for window coverings that can be folded for shipping.

Another object of the invention is to provide an improved valance system for window coverings that can be shipped in the same shipping box as a broken down track system.

Yet another object of the invention is to provide an improved valance system for window coverings that does not require a shipping box that is longer than a broken down track system.

Another object of the invention is to provide an improved valance system for window coverings that can be installed quickly.

Yet another object of the invention is to provide an improved valance system for window coverings that can be replaced quickly.

Another object of the invention is to provide an improved valance system for window coverings that is easy to cover with material.

Yet another object of the invention is to provide an improved valance system for window coverings that is formed of a minimum number of parts.

Another object of the invention is to provide an improved valance system for window coverings that is relatively inexpensive.

Yet another object of the invention is to provide an improved valance system for window coverings that has a long useful life.

Another object of the invention is to provide an improved valance system for window coverings that is easily customized.

Yet another object of the invention is to provide an improved valance system for window coverings that can be easily cut to size.

Another object of the invention is to provide an improved valance system for window coverings that can be used in most applications.

Yet another object of the invention is to provide an improved valance system for window coverings that is standardized.

Another object of the invention is to provide an improved valance system for window coverings that allows for the customized end caps.

Yet another object of the invention is to provide an improved valance system for window coverings that uses a minimum amount of material.

Another object of the invention is to provide an improved valance system for window coverings that is lightweight.

Yet another object of the invention is to provide an improved valance system for window coverings that is durable.

Another object of the invention is to provide an improved valance system for window coverings that has a long useful life.

Yet another object of the invention is to provide an improved valance system for window coverings that can be easily extended.

Yet another object of the invention is to provide an improved valance system for window coverings that utilizes an end cap that can be configured in a number of ways.

These and other objects, features, or advantages of the invention will become apparent from the specification and claims.

SUMMARY OF THE INVENTION

A valance system for a window covering that can be folded and placed within the same shipping box as a wall bracket, top bracket and track sections. The valance extends a length between opposing ends and includes a clip feature that extends out from its rearward side. The clip feature is generally C-shaped or U-shaped when viewed from the side and includes a plurality of friction members in its exterior surface. The clip feature is removed in one or more sections to facilitate bending of the valance. The valance is covered with a covering material which is stapled to the valance in staple sections. An end cap having a hinge area that facilitates bending of the end cap is connected to the ends of the valance by connection of a tongue of the end cap to a slot of the valance. The clip feature is sized and shaped to frictionally fit within and be installed within a socket of a top bracket without any tools. This arrangement provides an inexpensive, standardized, quick and easy method of installing a valance on a window covering.

BRIEF DESCRIPTION OF THE DRAWINGS

FIG. 14A is a close up rear elevation view of a tongue of an end cap;

FIG. 14B is a close up rear elevation view of the living hinge area of an end cap;

FIG. 14C is a close up side elevation view of a tongue of an end cap;

FIG. 14D is a close up side elevation view of the living hinge area of an end cap;

FIG. 15A is a rear elevation view of a right end cap;

FIG. 15B is a side elevation view of a right end cap;

FIG. 15C is a close up rear elevation view of a tongue of a right end cap;

DETAILED DESCRIPTION

Figure 1:
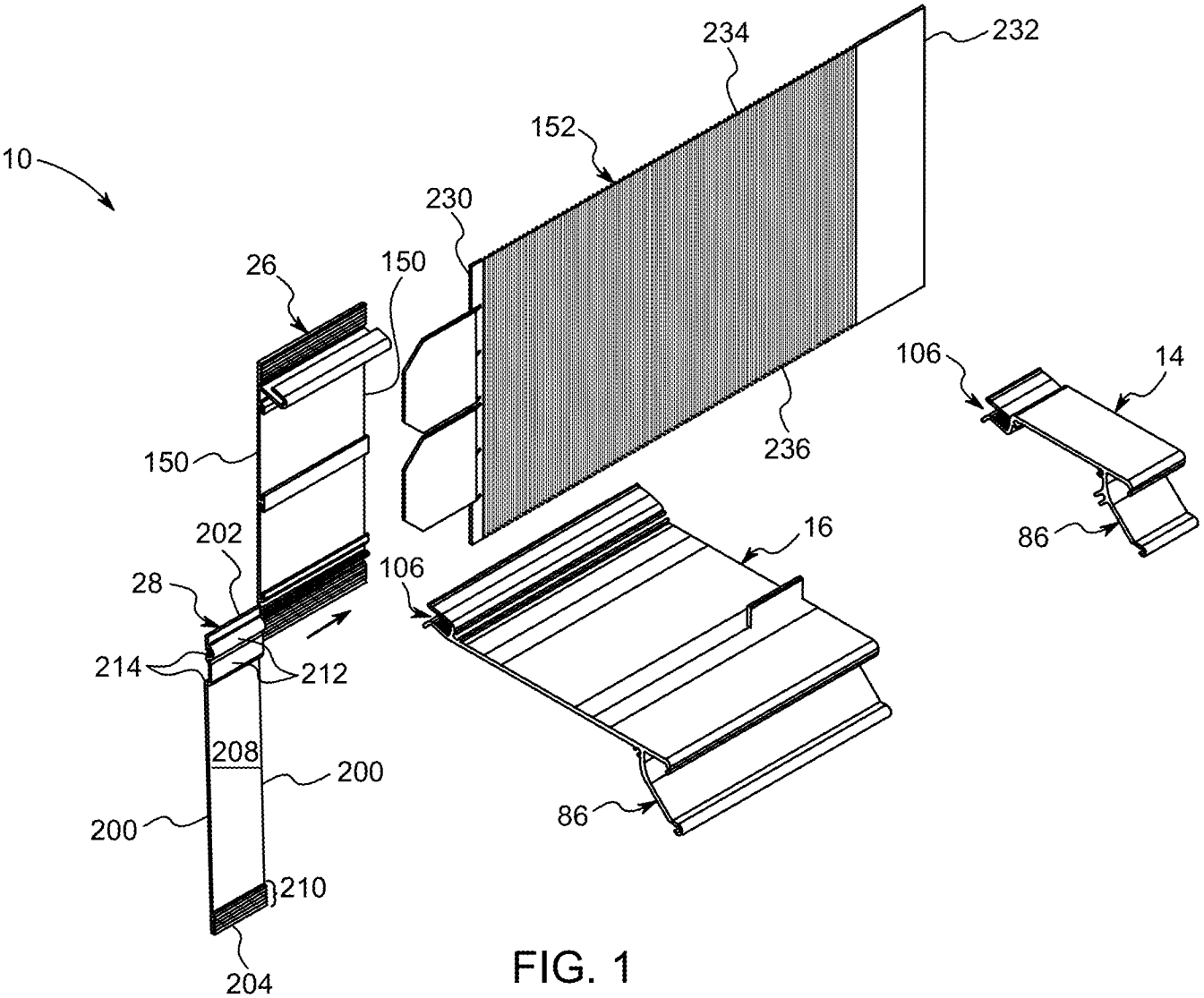
FIG. 1 is an exploded perspective view of a valance system, the view showing a the back side of a valance, a valance extension, and an end cap that is connectable to the valance, the view also showing a single track top bracket and a double track top bracket.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention. The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end, sides, and the like, are referenced according to the views presented and/or the orientation of the parts/components with respect to one another. It should be understood, however, that the terms are used only for purposes of description, and are not intended to be used as limitations. Accordingly, orientation of an object or a combination of objects may change without departing from the scope of the invention.

While the figures show the invention used in association with a window covering that is a drapery track system and/or a dual drapery track system, the invention is not so limited. A drapery track system is simply used as an example, and the features or advantages of the arrangement can be applied to any form of a window covering, and for that matter any mechanical and/or electromechanical device or system.

With reference to the figures, a valance system 10 (system 10) is presented. Valance system 10 is formed of any suitable size, shape and design. In the arrangement shown, as one example, valance system 10 includes a wall bracket 12, a single track top bracket 14, a dual track top bracket 16, a first track 18, a second track 20, first shade material 22, second shade material 24, a valance 26, a valance extension 28, among other components, parts and pieces as is shown and/or described herein.

Wall Bracket: Wall bracket 12 is formed of any suitable size shape and design and serves to connect valance system 10 to a wall or other structure. In one arrangement, as is shown, wall bracket 12 is formed of an extrusion that extends a length between opposing ends 30 and has a generally constant shape along its length.

As one example, wall bracket 12 includes a main body 32 that is generally rectangular in shape. Main body 32 extends horizontally between a generally flat rear wall 34 positioned in approximate parallel spaced alignment to a generally flat front wall 36. Main body 32 extends vertically between a generally flat upper wall 38, that extends in approximate perpendicular alignment to the rear wall 34 and front wall 36, and a lower end 40.

A lower arm 42 is connected to lower end 40 of main body 32 and extends outward and downward from main body 32 at an angle. The downward and outward end of lower arm 42 includes a rounded nose 44 and a lip 46 that terminates in a lower end 48. In the arrangement shown, lip 46 extends downward and rearward at an angle from rounded nose 44.

An upper arm 50 is connected to main body 32. In one arrangement, upper arm 50 connects to forward wall 36 between upper wall 38 and lower end 40 and extends forward a distance in approximate perpendicular alignment to the plane of rear wall 34 and forward wall 36. A flange 52 is connected to the outward end of upper arm 50 and extends upwardly a distance therefrom. Flange 52 extends upward in approximate perpendicular alignment to the upper arm 50.

The upper end of flange 52 includes a first rounded nose 54 and a second rounded nose 56. First rounded nose 54 and second rounded nose 56 are positioned in approximate horizontal opposing alignment to one another with first rounded nose 54 pointing rearward toward main body 32 and second rounded nose 56 pointing forward away from main body 32. An upper wall 58 connects the upper end of first rounded nose 54 and second rounded nose 56. Upper wall 58 has a generally flat and planar surface that extends in approximate perpendicular alignment to the rear wall 34 and forward wall 36 of main body 32. In the arrangement shown, while first rounded nose 54 is generally configured to be solid, the second rounded nose 56 includes a hollow interior 60 that is generally cylindrical or partially cylindrical in shape. This hollow interior 58 serves as a screw boss or opening that threadably receives a fastener such as a screw or bolt.

Main body 32 also includes a plurality of openings 62 therein that allow for the passage of fasteners there through that facilitates connection of the wall bracket 12 to a wall or structure.

Top Bracket: Top brackets 14, 16 are formed of any suitable size shape and design and serve to connect to wall bracket 12 and support one or more tracks 18, 20. In one arrangement, as is shown, there are two top brackets 14, 16 presented. Single track top bracket 14 is configured to support a first track 18, and a dual track top bracket 16 is configured to support a first track 18 and a second track 20. In the arrangement shown, the single track top bracket 14 and the dual track top bracket 16 are generally similar with one difference being that the upper wall 70 of the dual track top bracket 16 being longer in length than the upper wall 70 of the single track top bracket 14. As such, other than the configuration of the upper wall 70, reference will be made to the components of the top brackets 14, 16 simultaneously.

As one example, top brackets 14, 16 include an upper wall 70 that is generally rectangular in shape and extends vertically between an upper surface 72 that is generally planar in shape and a lower surface 74 that is also generally planar in shape, with the upper surface 72 and the lower surface 74 positioned in approximate perpendicular alignment to one another. Upper wall 70 extends a distance between rearward end 76 and forward end 78.

Rearward end 76 of upper wall 70 includes a hook feature 80 that extends downward from upper wall 70 in curved fashion and includes a socket 82 that has a curved surface that is sized and shaped to matingly engage and receive the rearward facing first rounded nose 54 of wall bracket 12 when top bracket 14, 16 is hung on wall bracket 12. A flat surface 84 is positioned forward of hook feature 80 that is configured to flushly engage the flat upper wall 58 of wall bracket 12 when top bracket 14, 16 is hung on wall bracket 12.

A support arm 86 is positioned forward a distance from rearward end 76, hook feature 80 and flat surface 84. Support arm 86 includes a first section 88 that extends downward from the lower surface 74 of upper wall 70 a distance in approximately perpendicular alignment. Support arm 86 includes a second section 90 that connects to first section 88 at corner section 92. Second section 90 angles rearward as it extends downward. Second section 90 terminates at a lower end 94. Lower end 94 terminates in a rounded nose 96 that faces rearward and includes a hollow interior 98 that is generally cylindrical or partially cylindrical in shape. This hollow interior 98 serves as a screw boss or opening that is sized and shaped to threadably receive a fastener such as a screw or bolt, as is further described herein.

Top bracket 14, 16 also includes a screw boss 100 positioned at the intersection of support arm 86 and upper wall 70. In the arrangement shown, screw boss 100 is positioned on the forward side of support arm 86 and includes a pair of lips 102 that define a hollow interior 104 that is sized and shaped to threadably receive a fastener such as a screw or bolt, as is further described herein.

The forward end 78 of upper wall 70 includes a socket 106. Socket 106 is formed of any suitable size, shape and design and is configured to receive and hold a clip feature 108 of valance 26. In one arrangement, as is shown, socket 106 is formed a lower wall 110 and an upper wall 112 that are connected to one another by a center wall 114 and form a hollow receiving space 116 there between. Lower wall 110 and upper wall 112 extend in approximate parallel spaced alignment to one another, with center wall 114 connecting to the rearward ends of lower wall 110 and upper wall 112 in approximate perpendicular alignment thereto. In this way, the connection of lower wall 110, upper wall 112 and center wall 114 form a generally rectangular or C-shaped receiving space 116.

While lower wall 110 and upper wall 112 extend in an approximate flat and planar manner, when viewed from the side, the planes of lower wall 110 and upper wall 112 are positioned at an angle, and not in planar alignment, to the plane formed by upper wall 70 of top bracket 14, 16. That is, the receiving space 116 angles slightly downward as it extends rearward. Or, said another way, the open end of receiving space 116 faces slightly upward. This slight downward angle helps to hold clip feature 108 within receiving space 116 and prevent unintentional dislodgement.

In the arrangement shown, the upper surface of lower wall 110 includes one or more friction members 118 that serve to impart friction onto clip feature 108 when it is within receiving space 116 thereby helping to hold clip feature 108 within receiving space 116. In the arrangement shown, friction members 118 are a plurality of protrusions or bumps, however any other form of a friction imparting device is hereby contemplated for use such as adhesive, glue, sand paper, tack, or the like.

In the arrangement shown, the forward end of lower wall 110 includes a flange 120 that extends slightly outward as it extends downward. Flange 120 provides increased surface area to the end of lower wall 110 which provides support to the inward surface of valance 26 below clip feature 108 as well as provides a larger positive stop for full insertion of valance 26.

Top bracket 14, 16 also includes a screw boss 122 positioned at the intersection of upper wall 70 and socket 106. In the arrangement shown, screw boss 122 is positioned on the rearward side of center wall 114 of socket 106 and on upper side of upper wall 70 and includes a pair of lips 124 that define a hollow interior 126 that is sized and shaped to threadably receive a fastener such as a screw or bolt, as is further described herein.

Tracks: First track 18 and second track 20 are formed of any suitable size, shape and design and serve to hold first shade material 22 and second shade material 24, respectively. In one arrangement, as is shown, tracks 18, 20 are generally square or rectangular in shape, when viewed from the side and extend a length between opposing ends 130. In the arrangement shown, tracks 18, 20 include an upper wall 132, a lower wall 134 and opposing sidewalls 136 that define a hollow interior 138. Upper wall 132 includes a slot 140 therein that is sized and shaped to receive a connecting member 142 therein that serves to connect track 18, 20 to upper wall 70 of top bracket 14, 16. Lower wall 134 also includes a slot 143 therein that allows passage of carriers 144 there through that connect shade material 22, 24 to tracks 18, 20. That is, hollow interior 138 receives carriers 144 therein that slidably move between ends 130 and connect to shade material 22, 24 thereby opening and closing shade material 22, 24.

Valance: Valance 26 is formed of any suitable size, shape and design and serves to connect to top bracket 14, 16 and hang downward therefrom a distance to provide a visual cover for components of the system 10, such as the tracks 18, 20. Valance 26 serves as a support to or backing for material which is connected to the valance 26 that provides an improved aesthetic purpose, as is further described herein. In one arrangement, valance 26 is formed of an extrusion that is generally constant in size, shape and design from end.

In the arrangement shown, valance 26 extends a lateral length between opposing ends 150 that connect to end caps 152, as is further described herein. In one arrangement, valance 26 is formed of an extrusion that is generally constant in size, shape, and design from end 150 to end 150.

Valance 26 extends vertically between an upper end 154 and a lower end 156, which extends in approximate parallel spaced relation to one another. Valance 26 includes a forward face 158, which is generally flat and planar and a rearward face 160 that is also generally flat and planar and includes a plurality of features as is described further herein. Forward face 158 and rearward face 160 extend in approximate parallel spaced alignment.

The rearward side of valance 26 includes an upper staple area 162, which is positioned at or near the upper end 154, and a lower staple area 164, which is positioned at or near the lower end 156. In one arrangement, as is shown, staple areas 162, 164 are formed of a thicker section of material than the other portions of valance 26, or a thicker band of material. This area or band of increased thickness serves to provide an area that receives fabric staples 166 therein that secure covering material 168 to the valance 26 as is further described herein. In the arrangement shown, staple areas 162, 164 include a plurality of protrusions that extend rearward and outward from the rearward face 160 a distance, however, it is also contemplated that staple areas 162, 164 are a solid piece or strip of material that is connected to or formed as part of valance 26, without a plurality of protrusions.

The rearward side of valance 26 also includes clip feature 108. Clip feature 108 is formed of any suitable size, shape and design and serves to frictionally connect valance 26 to socket 106 of top bracket 14, 16. In the arrangement shown, as one example, clip feature 108 is positioned at or near the upper end 154 of valance 26 and extends outward and slightly downward therefrom. In the arrangement shown, clip feature 108 includes an arm 170 that extends outward from the rearward face 160 of valance 26 a distance. The outward end of arm 170 connects to a rounded nose 172 that connects to flange 174. Arm 170 and flange 174 extend in approximate parallel spaced relation to one another and thereby form a slot 176 there between. The lower side of arm 170 includes a plurality of friction members 178 that serve to impart friction onto the socket 106 of top bracket 14, 16 when clip feature 108 is within receiving space 116 thereby helping to hold clip feature 108 within receiving space 116. In the arrangement shown, friction members 118 are a plurality of protrusions or bumps, however any other form of a friction imparting device is hereby contemplated for use such as adhesive, glue, sand paper, tack, or the like. In one arrangement, as is shown, the friction members 178 of clip feature 108 correspond in size and shape with the friction members 118 of socket 106 such that the two sets of friction members 178 and 118 frictionally and fittingly engage one another thereby providing increased hold between clip feature 108 and top bracket 14, 16.

In one arrangement, as one example, the friction members 118 of socket 106 are formed of rounded protrusions that are spaced apart from one another and friction members 118 of clip member 108 are formed of rounded protrusions that are spaced apart from one another. The spacing of the friction members 118 of socket 106 is complimentary or corresponds to the spacing of the friction members 178 of clip feature 108 such that when the clip feature 108 is fully inserted within the socket 106 the friction members 178 of clip feature 108 are pushed over and past the friction members 118 of socket 106. Once inserted, the friction members 178 of clip feature 108 are in engagement with the friction members 118 of socket 106 thereby preventing unintentional escape of the clip feature 108 from socket 106.

The rearward side of valance 26 includes an upper arm 180, a lower arm 182 and a center arm 184. The upper arm 180, lower arm 182 and center arm 184 extend outward from rearward face 160 a distance and include a flange that extend in approximate parallel spaced relation to the rearward face 160 of valance 26 a distance thereby defining a slot 186 therein. Slots 186 are sized and shaped to slidably receive tongues 188 connected to end cap 152, as is further described herein.

The rearward side of valance 26 also includes an alignment feature 190. Alignment feature 190 is formed of any suitable size, shape, and design and serves to connect and align valance extension 28 to valance 26. In the arrangement shown, alignment feature 190 is positioned at or near the lower end 156 of valance 26. More specifically, in the arrangement shown, alignment feature 190 is positioned just above the lower staple area 164. Alignment feature includes a bulbous nose 192 connected to a narrower stem 194 that extends nose 192 outward from the rearward surface of valance 26 a distance.

The lower end 156 of valance 26 also includes a second alignment feature 196. In the arrangement shown, second alignment feature 196 is a downward facing recess, curve, or cup. The combination of alignment feature 190 and second alignment feature 196 provide slidable connection points for valance extension 28, as is further described herein.

Valance Extension: Valance extension 28 is formed of any suitable size, shape, and design and serves to quickly and easily connect to the lower end 156 of valance 26 and extends the vertical height of the overall valance. In one arrangement, as is shown, like valance 26, valance extension 28 extends a lateral length between opposing ends 200 that connect to end caps 152, as is further described herein. In one arrangement, like valance 26, valance extension 28 is formed of an extrusion that is generally constant in size, shape, and design from end 200 to end 200. Valance extension 28 extends vertically between an upper end 202 and a lower end 204, which extends in approximate parallel spaced relation to one another. Valance extension 28 includes a forward face 206, which is generally flat and planar and a rearward face 208 that is also generally flat and planar and includes a plurality of features as is described further herein. Forward face 206 and rearward face 208 extend in approximate parallel spaced alignment.

The rearward side of valance extension 28 includes a staple area 210, which is positioned at or near the lower end 204. In one arrangement, as is shown, staple area 210 is formed of a thicker section of material than the other portions of valance extension 28, or a thicker band of material. This area or band of increased thickness serves to provide an area that receives fabric staples 166 therein that secure covering material 168 to the valance extension 28 as is further described herein. In the arrangement shown, staple area 210 includes a plurality of protrusions that extend rearward and outward from the rearward face 208 a distance, however, it is also contemplated that staple area 210 is a solid piece or strip of material that is connected to or formed as part of valance extension 28, without a plurality of protrusions.

The upper end 202 of valance extension 28 also includes a socket 212 positioned at or near its upper end 202. Socket 212 is sized and shaped to receive alignment feature 190 of valance 26 therein. In one arrangement, as is shown, socket 212 includes a slot 214 that includes a pair of opposing arms 216 that extend inward at an angle. Socket 212 is sized and shaped to allow stem 194 to pass through slot 214 while socket 212 receives nose 192 within close tolerances while arms 216 hold the nose 192 therein.

A second alignment feature 218 is positioned below the socket 212 and is sized and shaped to connect to the second alignment feature 196 of valance 26 in mating engagement. In the arrangement wherein the second alignment feature 196 of valance 26 is a rounded socket, the second alignment feature 218 in valance extension 28 is a rounded protrusion that connects together in mating engagement.

In the arrangement shown, valance extension 28 also includes relief 220. Relief 220 provides room to receive the lower staple area 164 of valance 26 within the valance extension 28. The lower end of relief 220 connects to or provides support for second alignment feature 218.

Figure 2:
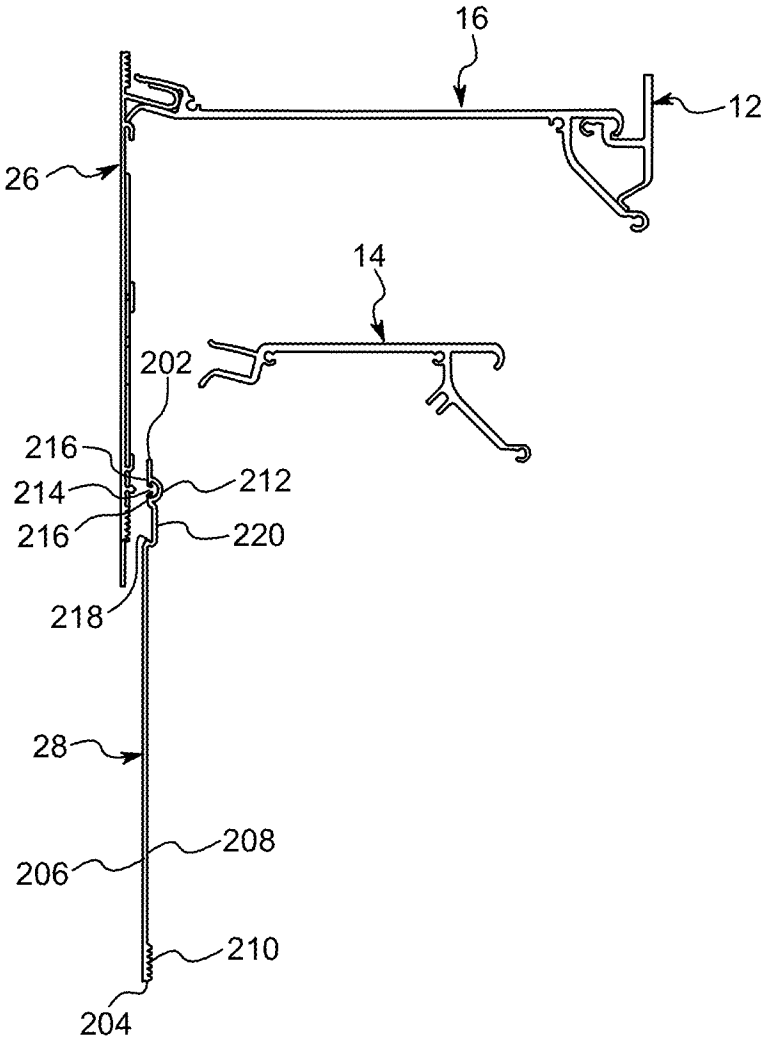
FIG. 2 is a side elevation view of the valance system of FIG. 1, the view showing the wall bracket, a dual track top bracket connected to the wall bracket, a valance connected to a socket in the outward end of the dual track top bracket, a valance extension positioned adjacent the lower end of the valance, and a single track top bracket.
Figure 4:
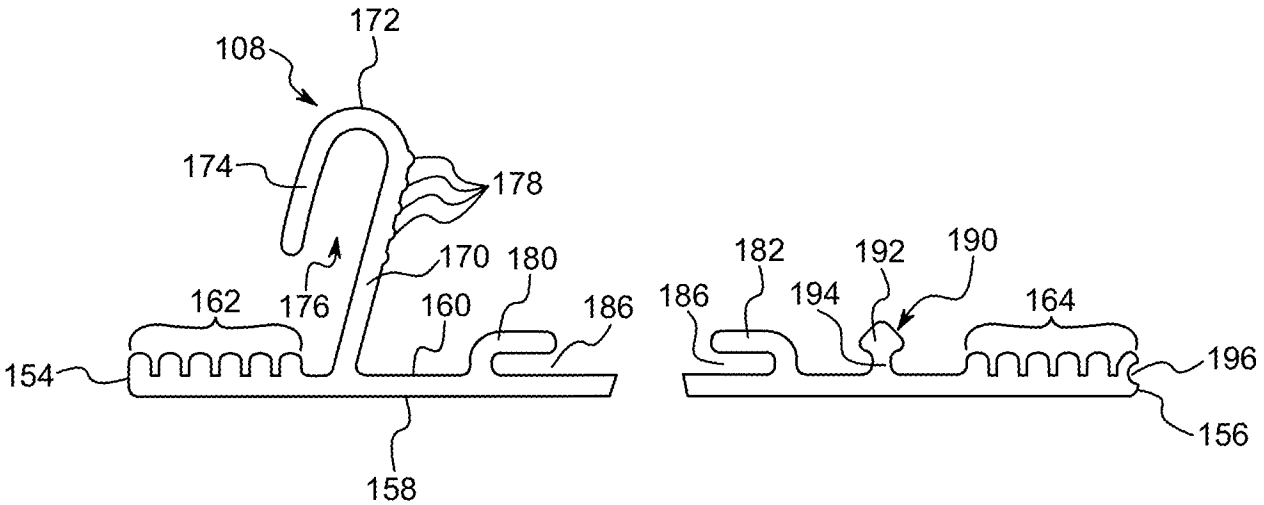
FIG. 4 is a close up side elevation view of the ends of a valance.
Figure 3:
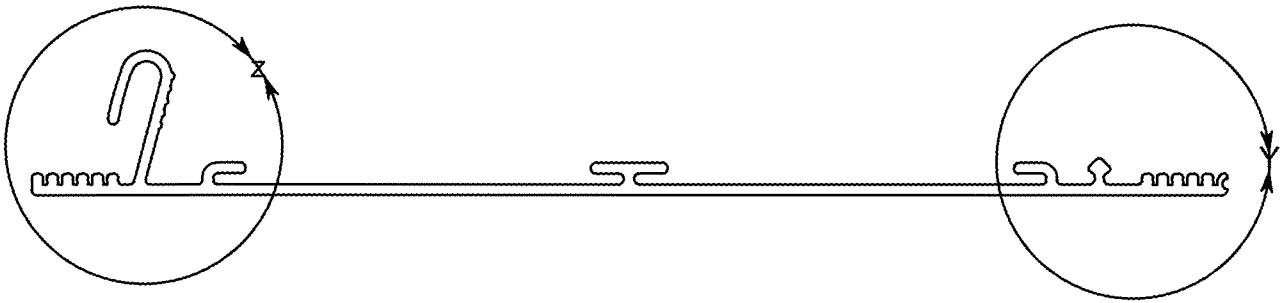
FIG. 3 is a side elevation view of a valance.
Figure 5:
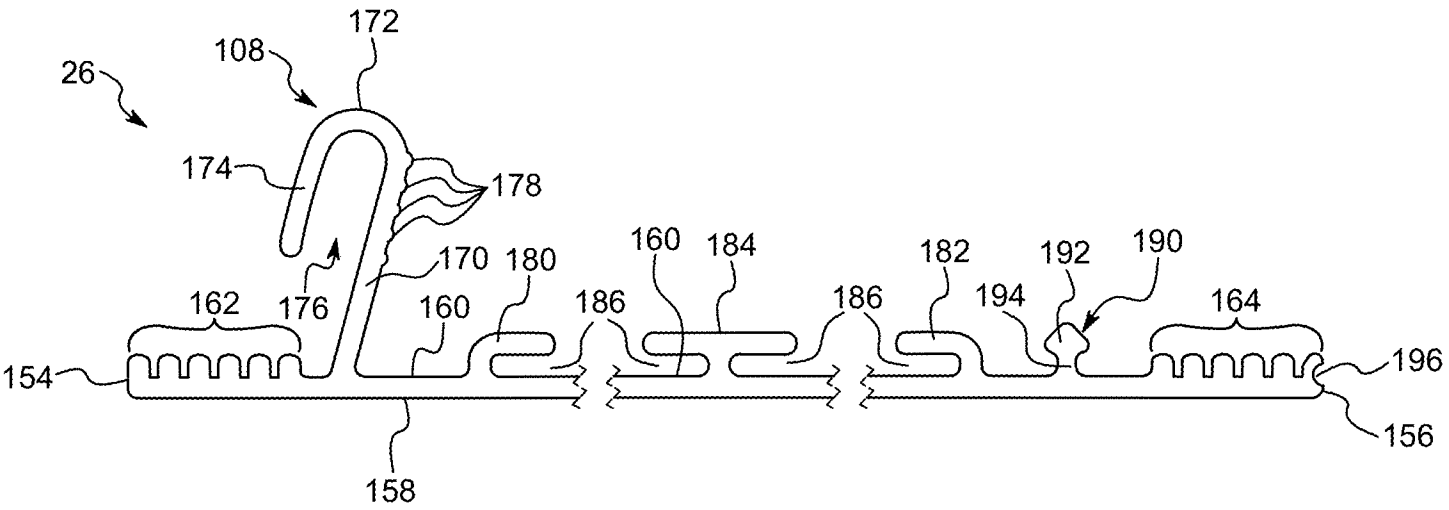
FIG. 5 a close up side elevation view of a valance showing the ends and middle of the valance.
Figure 6:
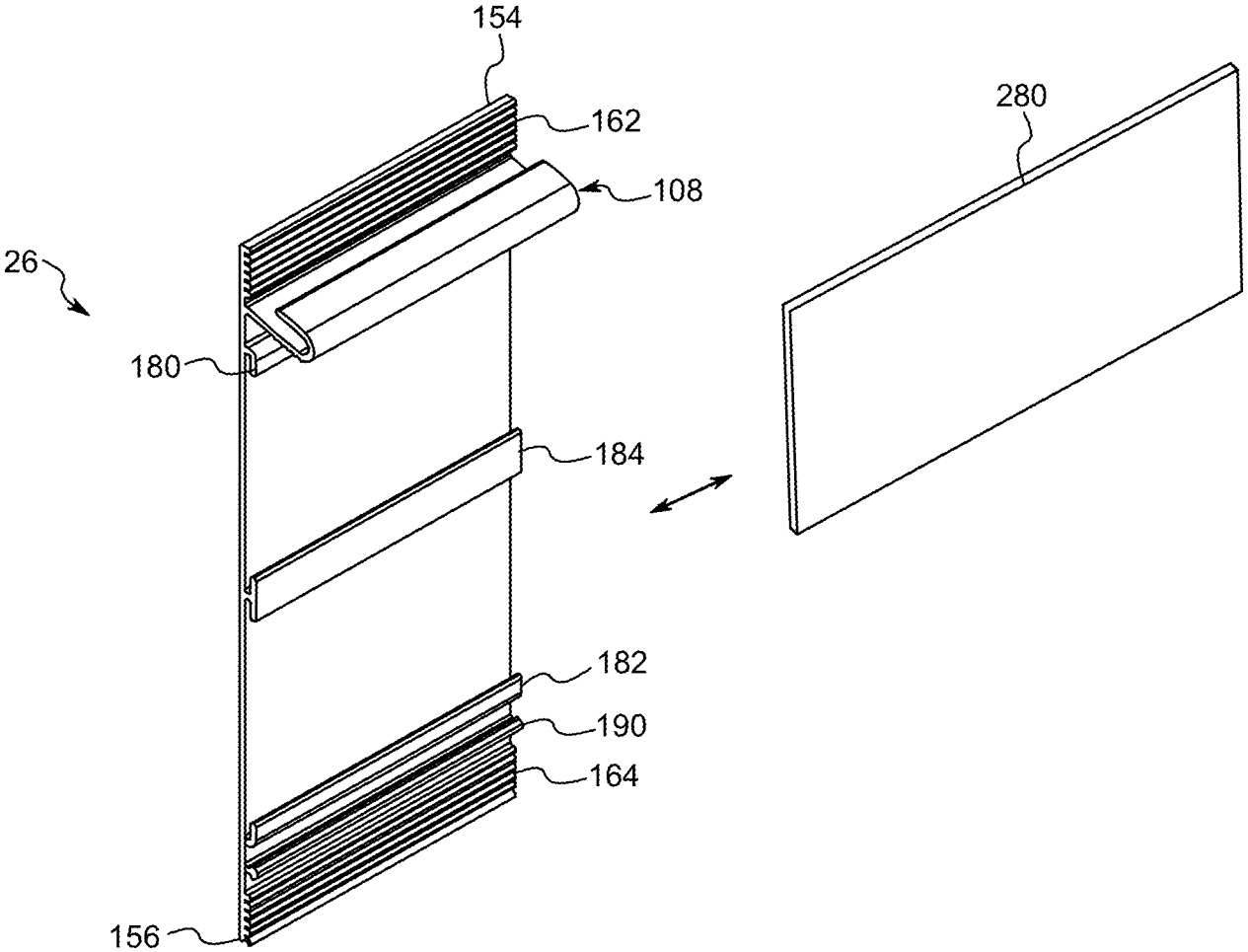
FIG. 6 is a perspective view of the rear side of a valance.
Figure 7:
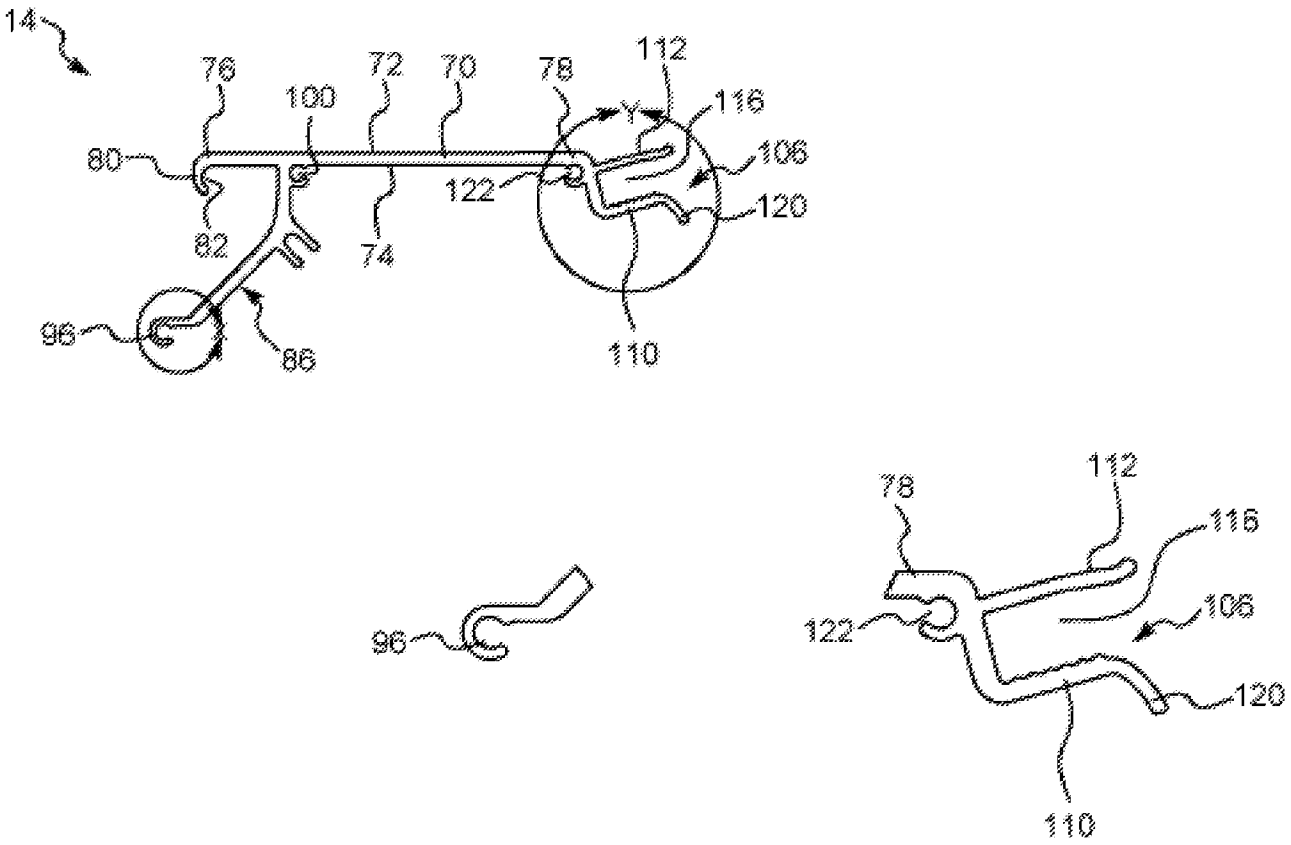
FIG. 7 is a side elevation view of a single track top bracket.
Figure 8:
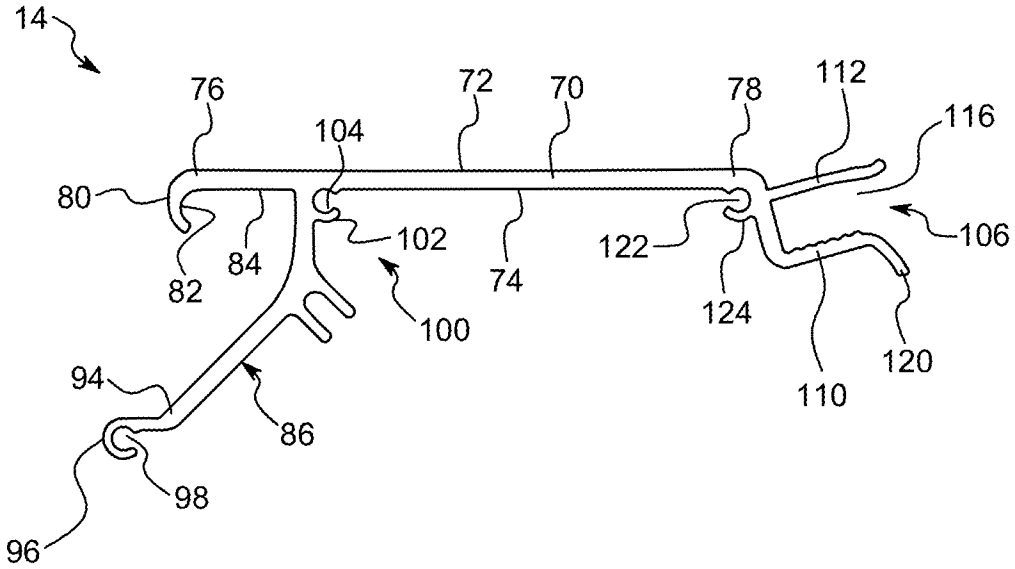
FIG. 8 is a side elevation view of a single track top bracket.
Figure 9:
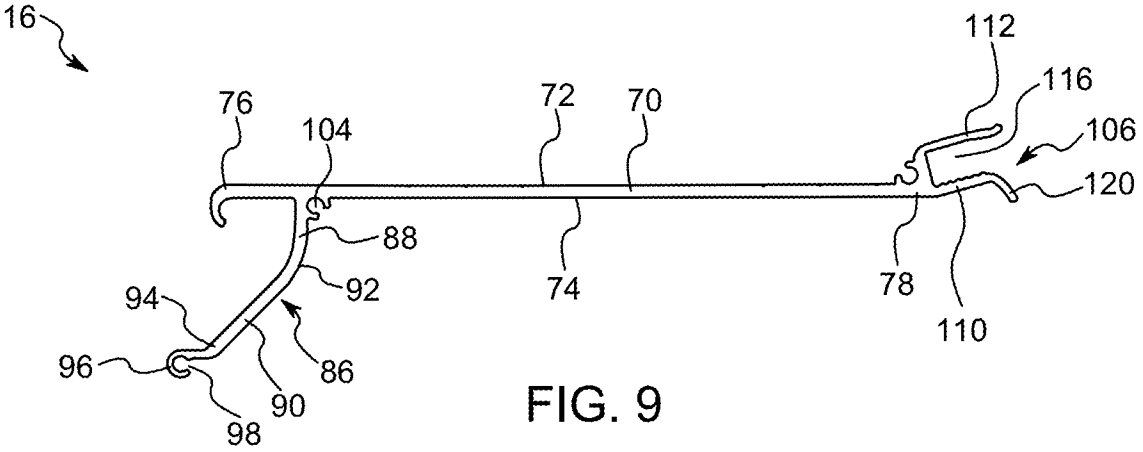
FIG. 9 is a side elevation view of a dual track top bracket.
Figure 10:
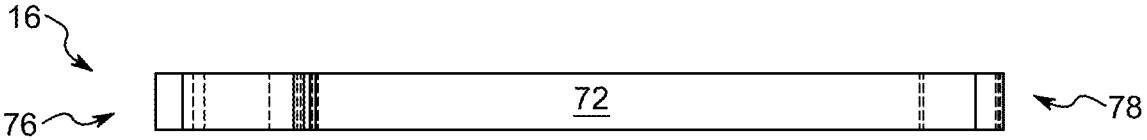
FIG. 10 is a bottom elevation view of a dual track top bracket.
Figure 11:
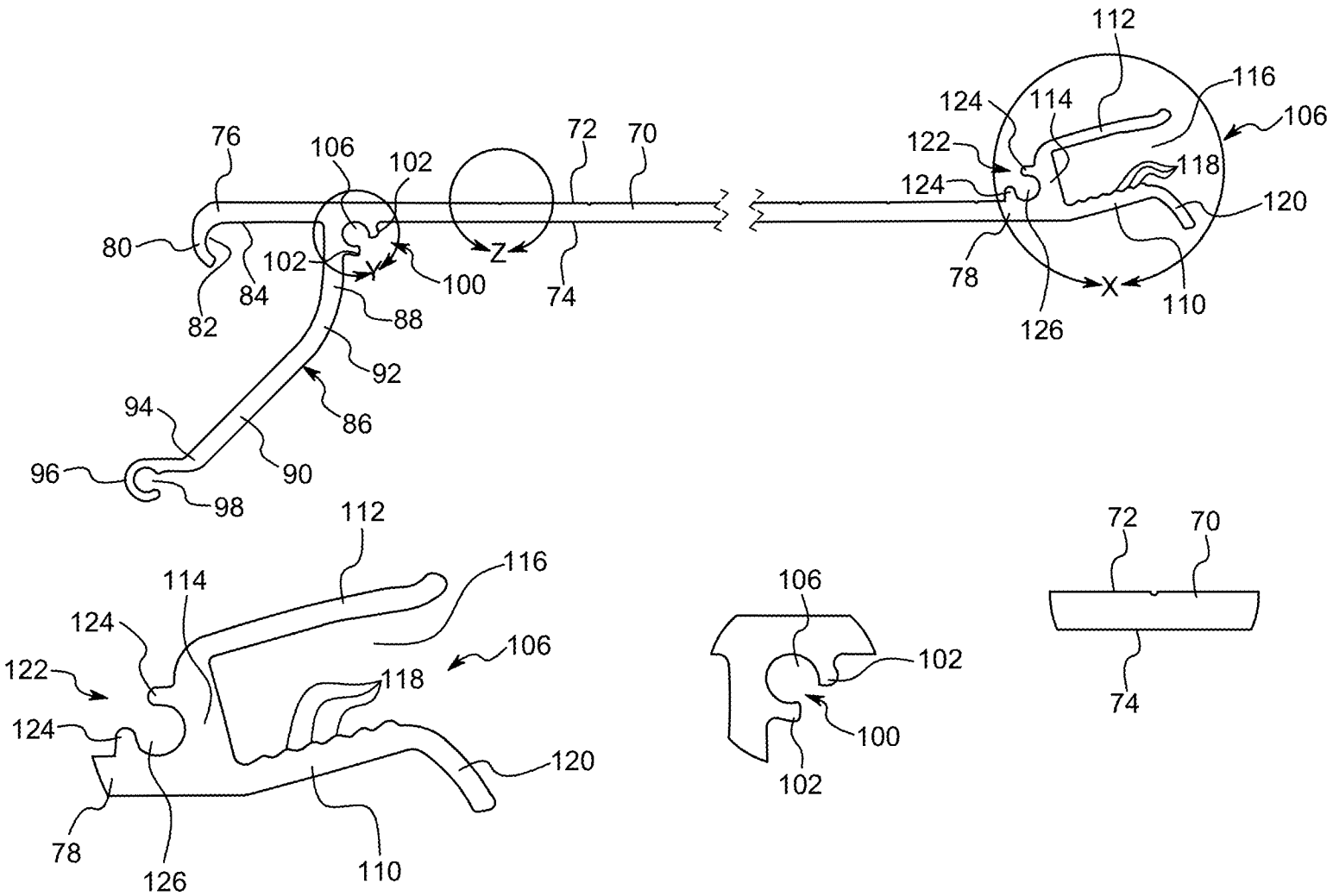
FIG. 11 is a side elevation view of a top bracket.
Figure 12:
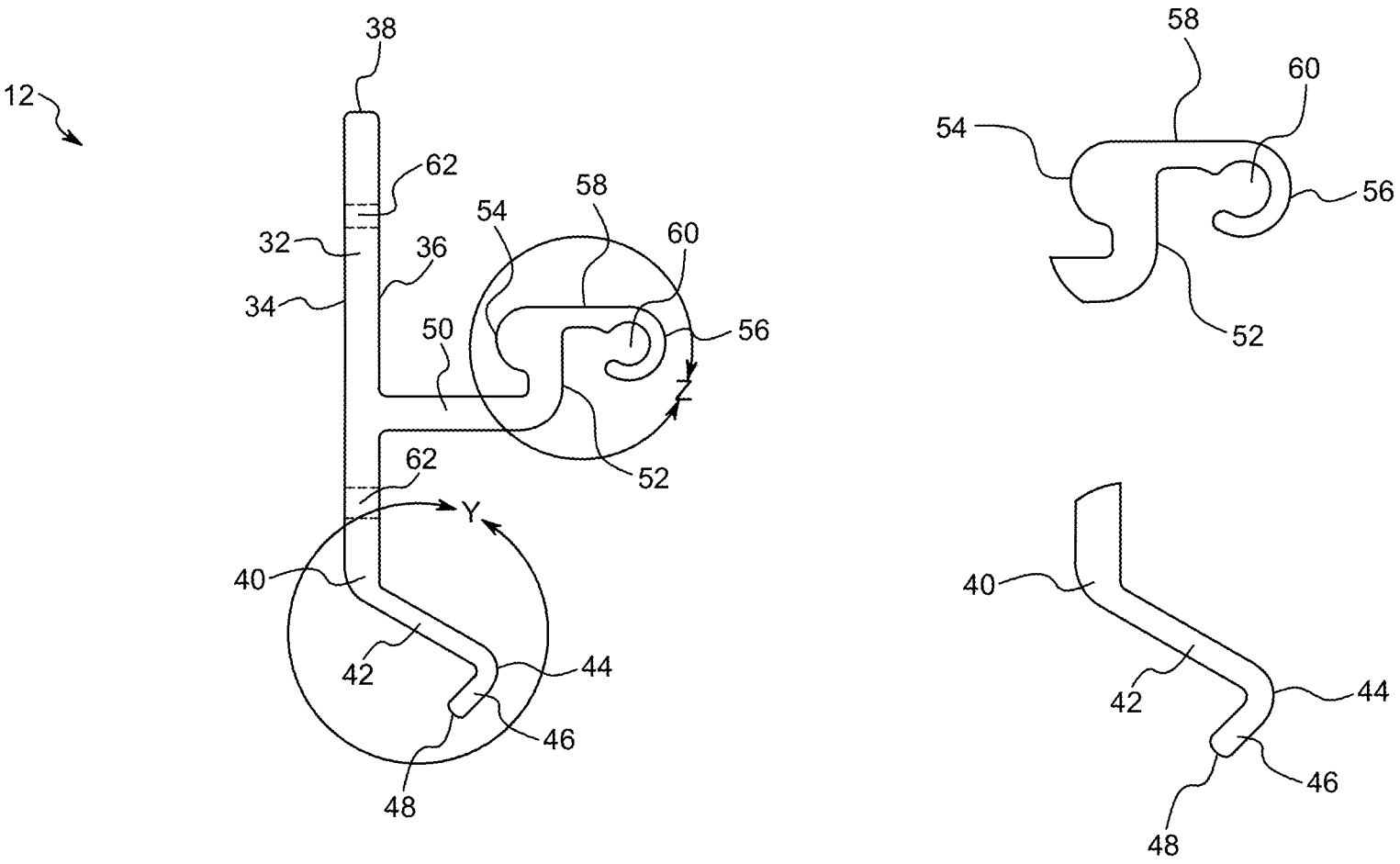
FIG. 12 is a side elevation view of a wall bracket.
Figure 13A:
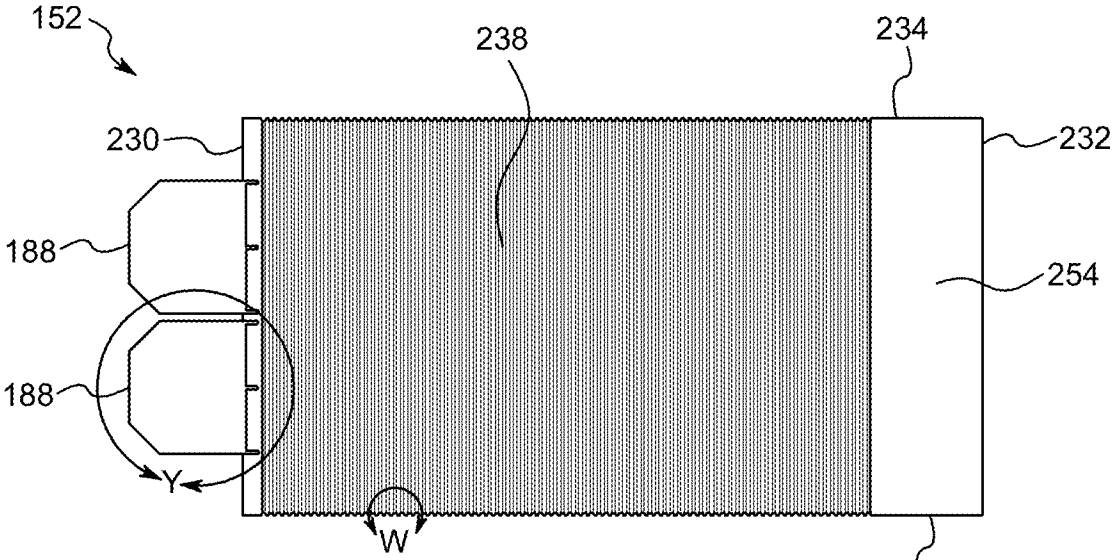
FIG. 13A is a rear elevation view of a left end cap.
Figure 13B:
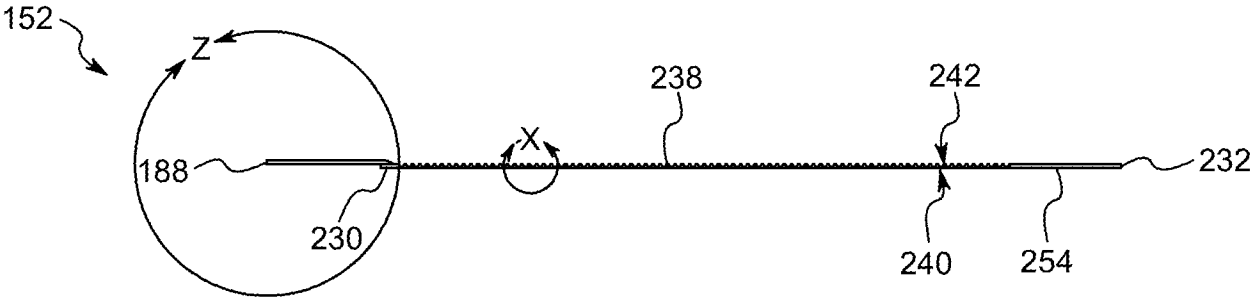
FIG. 13B is a side elevation view of a left end cap.
Figure 16:
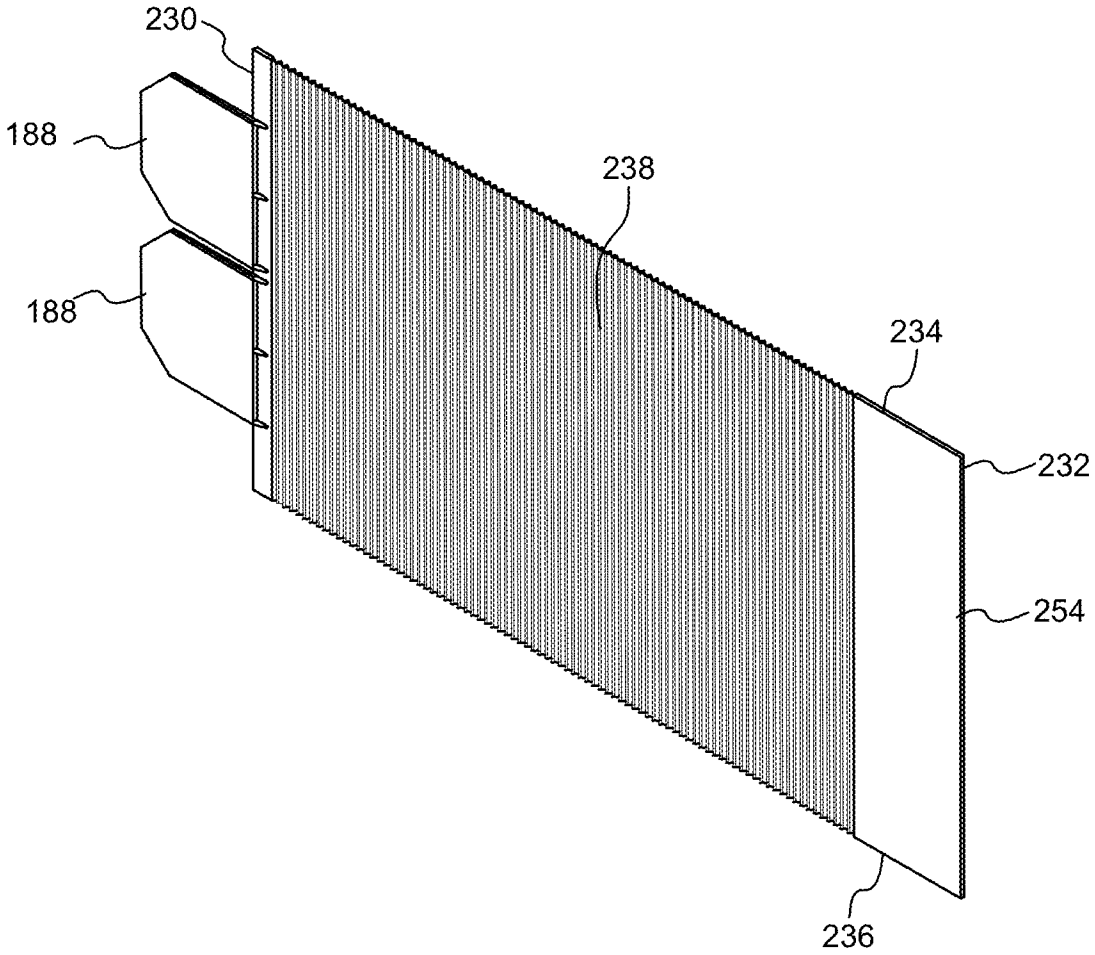
FIG. 16 is a rear perspective view of a left end cap.

Utilizing the combination alignment feature 190 and second alignment feature 196 of valance 26 and socket 212 and second alignment feature 218 of valance extension 28, valance 26 and valance extension 28 connect together and are held together. Valance extension 28 can slide onto valance 26 by aligning the socket 212 with the alignment feature 190 and the of valance 26 while simultaneously aligning the second alignment feature 218 with the second alignment feature 196 of valance 26 and sliding the valance extension 28 over and onto the valance (as is shown in FIG. 1, where sliding occurs along the direction of the arrow shown). Alternatively, valance extension 28 can snap onto valance 26 by aligning the socket 212 with the alignment feature 190 and the of valance 26 while simultaneously aligning the second alignment feature 218 with the second alignment feature 196 of valance 26 and pressing the valance extension 28 onto the valance 26 (as is shown in FIG. 2, where snapping occurs along the direction of the arrow shown).

End Cap: End cap 152 is formed of any suitable size, shape and design and serves to quickly and easily connect to the ends 150, 200 valance 26 and/or valance extension 28 and provides the ability to curve from the general flat forward face 158, 206 around the end of system 10 eventually connecting to the wall or structure. In this way, end cap 152 covers and closes the ends 150, 200 of system 10.

In one arrangement, as is shown, like valance 26 and valance extension 28, end cap extends a lateral length between inward end 230 and outward end 232. Inward end 230 is configured to connect to the end 150, 200 of valance 26 and/or valance extension 28. Outward end 232 is configured to connect to the wall or structure that supports valance system 10. End cap 152 extends vertically between an upper end 234 and a lower end 236, which extends in approximate parallel spaced relation to one another.

End cap 152 includes a hinge area 238. Hinge area 238 is an area or section of end cap 152 that serves to allow end cap 152 to curve from the generally flat forward face 158, 206 of valance 26, valance extension 28 to meet the wall or structure that supports system 10. In one arrangement, as is shown, hinge area 238 includes a plurality of recesses or grooves that extend from the upper end 234 to the lower end 236. In one arrangement, the grooves or recesses of hinge area 238 are placed in both the forward face 240 of end cap 152 and the rearward face 242 of end cap 252. In an alternative arrangement, the forward face 240 is flat, so as to provide better aesthetics, and only the rearward face 242 includes the recesses or grooves. In yet another alternative arrangement, the rearward face 242 is flat and only the forward face 240 includes the recesses or grooves.

In one arrangement, the presence of the recesses or grooves of hinge area 238 allows the end cap 152 to be bent to any desired angle or shape. That is, end cap 152 can be bent into a sharp corner, a smooth curve, any angle or any other desired configuration.

Hinge area 238 balances the ability to easily bend the end cap 152 to any desired configuration, while also providing enough rigidity to support and hold the selected configuration.

The inward end 230 of end cap 152 includes at least one tongue 188. Tongues 188 extend outward from inward end 230 a distance and are sized and shaped to fit within slots 186 valance 26. In the arrangement shown, tongues 188 are generally flat, elongated and square or rectangular in shape with the outward most corners chamfered or angled-off to aid with insertion of tongues 188 into slots 186. In the arrangement shown, two tongues 188 are used which are separated by a space that is sized and shaped to receive center arm 184, however any other number of tongues 188 are hereby contemplated for use.

To install the end cap 152 onto the valance 26, 28, the tongues 188 are aligned with slots 186 and the end cap 152 is slid inward until the inward end 230 is in flat and flush alignment and engagement with the outward end 150 of valance 26. In this position, the friction between tongues 188 and valance 26 holds end cap 152 in place. An adhesive, staples, tape or any other binding agent can also be used to help ensure the two components remain together after installation.

Once the end cap 152 is installed onto valance 28, the end cap 152 is bent to the desired configuration.

For applications that include valance extension 28, the height of end cap 152 matches the height of the combined valance 26 and valance extension 28. In this arrangement, end cap 152 may include a second set of tongues 188, and the valance extension 26 includes a set of slots 186 that connect to one another.

End caps 152 may also include staple areas along the rearward side of end caps along the upper end 234, lower end 236 and/or the outward end 232 to provide an area to receive fabric staples 166.

Covering Material: End caps 152 are installed on valance 26 or valance 26 and valance extension 28 by inserting tongues 188 within slots 186. Once end caps 152 are installed, the combined valance (which will be referred to simply as "valance 26" for purposes of simplicity) is covered with covering material 168. Covering material 168 is any material that covers valance 26. In one arrangement, covering material 168 is the same material as the first shade material 22 or second shade material 24, so that the covered valance 26 matches the drapery. In another arrangement, covering material 168 is a different material, so that the covered valance 26 does not match the drapery.

To install the covering material 168, the covering material 168 is cut to shape and is placed over the forward face 158, 206, 240 of the valance 26. The upper end of the covering material 168 is stapled to upper staple area 162, and the lower end of the covering material is stapled to the lower staple area 164 or 210. The fabric staples 166 go into the staple areas but do not protrude through the forward face 158, 206, 240 of the valance 26 due to the increased thickness of the staple areas.

While stapling the covering material 168 is sufficient to hold covering material 168 onto valance 26, to improve this connection, adhesive and/or double sided tape may be used on the forward face 158, 206, 240 and/or any other component of valance 26.

This arrangement provides a quick, easy, simple and fool proof way of installing covering material 168 onto valance 26.

In one arrangement, the covering material is added at the factory and the valance 26 and/or the end caps 152 are shipped with the covering material 168 thereon. This eliminates the need for the user to add the covering material 168 in the field.

System Assembly: Once the valance 26 is assembled with end caps 152 and potentially valance extension 28, the system is assembled and installed.

Wall bracket 12 is installed onto the wall or structure to which system is to be attached by inserting fasteners, such as screws or bolts, through the wall bracket 12 and into the wall.

The appropriate top bracket 14, 16 is selected. In applications utilizing only a single track 18, single track top bracket 14 is selected. In applications utilizing a pair of tracks, dual track top bracket 16 is selected. Once the top bracket 14, 16 is selected, track(s) 18, 20 are installed by first aligning the track(s) 18, 20 with the top bracket 14, 16 and connecting a turn buckle 250 or fastening device to the track(s) 18, 20. In one arrangement, wherein turn buckle 250 is utilized, the flange of turn buckle 250 is inserted within the slot 140 in the upper wall 132 of the track(s) 18, 20 and is rotated thereby affixing the track(s) 18, 20 to top bracket 14, 16.

Once the track(s) 18, 20 are installed on top bracket 14, 16, top bracket 14, 16 is installed onto wall bracket 12. To do so, top bracket 14, 16 is raised above wall bracket 12 and aligned with the wall bracket 12 such that the hook feature 80 of top bracket 14, 16 reaches behind the first rounded nose 54 of wall bracket 12. To do this, the forward end of top bracket 14, 16 is raised above the rearward end of top bracket 14, 16 at an angle. Once in this position, the weight of the top bracket 14, 16 can rest on the wall bracket 12, which eases installation, and the forward end of top bracket 14, 16 is lowered as the hook feature 80 rotates over the first rounded nose 54 of wall bracket 12. This rotation continues until the flat surface 84 of top bracket 14, 16 engages the upper wall 58 of wall bracket 12, at which point the top bracket 14, 16 is fully lowered onto the wall bracket 12.

In this position, the inward surface of the lower end 94 of support arm 86 of top bracket 14, 16 engages the outward surface of lip 46 of wall bracket 12. Next, anchor plates 252 are installed onto wall bracket 14 and top bracket 14, 16 thereby connecting the two components together and preventing unintentional removal of the top bracket 14, 16 from the wall bracket 12. Anchor plates 252 are installed by passing a fastener, such as a screw or bolt or the like through anchor plate 252 and into the hollow opening 60 (or screw boss) of wall plate 12 and the hollow interiors 98 and 104 (also each a screw boss) of top bracket 14, 16. Once anchor plate 252 is screwed or bolted to both the top bracket 14, 16 and wall bracket 12, the two components are affixed to one another and cannot be separated unintentionally without removal of the anchor plates 252.

Once the top bracket 14, 16 is installed onto the wall bracket 12 and locked there on by anchor plates 252, shade material 22, 24 is installed onto tracks 18, 20 by carriers 144 held within tracks 18, 20.

Once the shade material 22, 24 is installed, the assembled valance 26 (which may include valance extension 28 as well as end caps 152) which is covered by covering material 168 is installed onto top bracket 14, 16. This is accomplished by aligning the clip feature 108 of valance 26 with the socket 106 of top bracket 14, 16. Once aligned, the clip feature 108 is forced within the socket 106. The partially flexible, but resilient, clip feature 108 flexes to accommodate the size of the generally rigid socket 106. That is, the rounded nose 172 tends to flex or bend allowing the flange 174 and arm 170 to fit within the socket 106. As the clip feature 108 is inserted within socket 106, the friction members 178 of clip feature 106 engage and pass over the friction member 118 of socket 106. As these friction members 118, 178 engage one another additional force must be applied to insert and/or remove the clip feature 108 from socket 106, which helps to prevent unintentional removal of valance 26 from top bracket 14, 16.

When fully installed, the rounded nose 172 of clip feature 106 engages or is adjacent the center wall 114 of socket 106, the flange 174 is in engagement with the upper wall 112 of socket 106, and the arm 170 is in engagement with the lower wall 110 with the friction members 118, 178 in engagement with one another.

In this way, assembled valance 26 is quickly and easily installed onto top bracket 14, 16.

To remove valance 26, the opposite process is performed. That is, instead of applying an inward force to valance 26 when installing valance 26, an outward force is applied to valance 26, thereby pulling clip feature 108 out of socket 106.

In this way, valance 26 can be quickly, easily and safely installed and removed from top bracket 14, 16 without any tools or sophisticated processes. In addition, by providing the socket 106 that extends the length of the top bracket 14, 16 and by providing the clip feature 108 that extends the length of the valance 26, this allows for connection between the valance 26 and the top bracket 14, 16 along their entire lengths, except for the small areas wherein the clip feature 108 was removed for the purposes of bending. This extensive area of connection ensures that the valance 26 is straight and has a pleasing aesthetic appearance, while still being inexpensive, standardized, quick and easy to install, among other advantages.

Shipping: One problem related to using valances in association with window shading systems is that the valance is highly visible and therefore cannot include seams or other obstructions or deviations. Other components of the window shading system, such as tracks 18, 20, wall bracket 12, top bracket 14, 16 often are shipped in pieces which are then assembled into longer components at the sight of installation. Seams between these parts are acceptable because they are largely hidden from view by the valance. However, such is not the case with the valance 26.

To provide the best possible appearance, it is desirable to provide a single continuous valance 26 that is uninterrupted by seams. However, due to many applications being well over ten or twenty feet in length, shipping a rigid continuous piece that extends the entire length of the application would be complicated and expensive. In addition, getting a rigid continuous piece in place in many applications would be impossible because it would not fit in elevators, up stairwells or around corners or the like. As such, to reduce shipping costs, allow for packaging within the same packaging as the broken down brackets 12, 14, 16 and tracks 18, 20, while still providing a continuous, uninterrupted valance 26 it is desirable to bend the valance 26 to fit within the shipping container.

To accomplish this, valance 26 is formed of a rigid yet partially flexible and bendable material. To further facilitate bending, in one arrangement, the clip feature 108 is removed from the areas where the bend is to occur. As one example, with reference to FIGS. 19 and 21, the clip feature 108 has been cut away at the center of valance 26, thereby allowing for folding of the valance 26 where the clip feature 108 has been removed.

Figure 19:
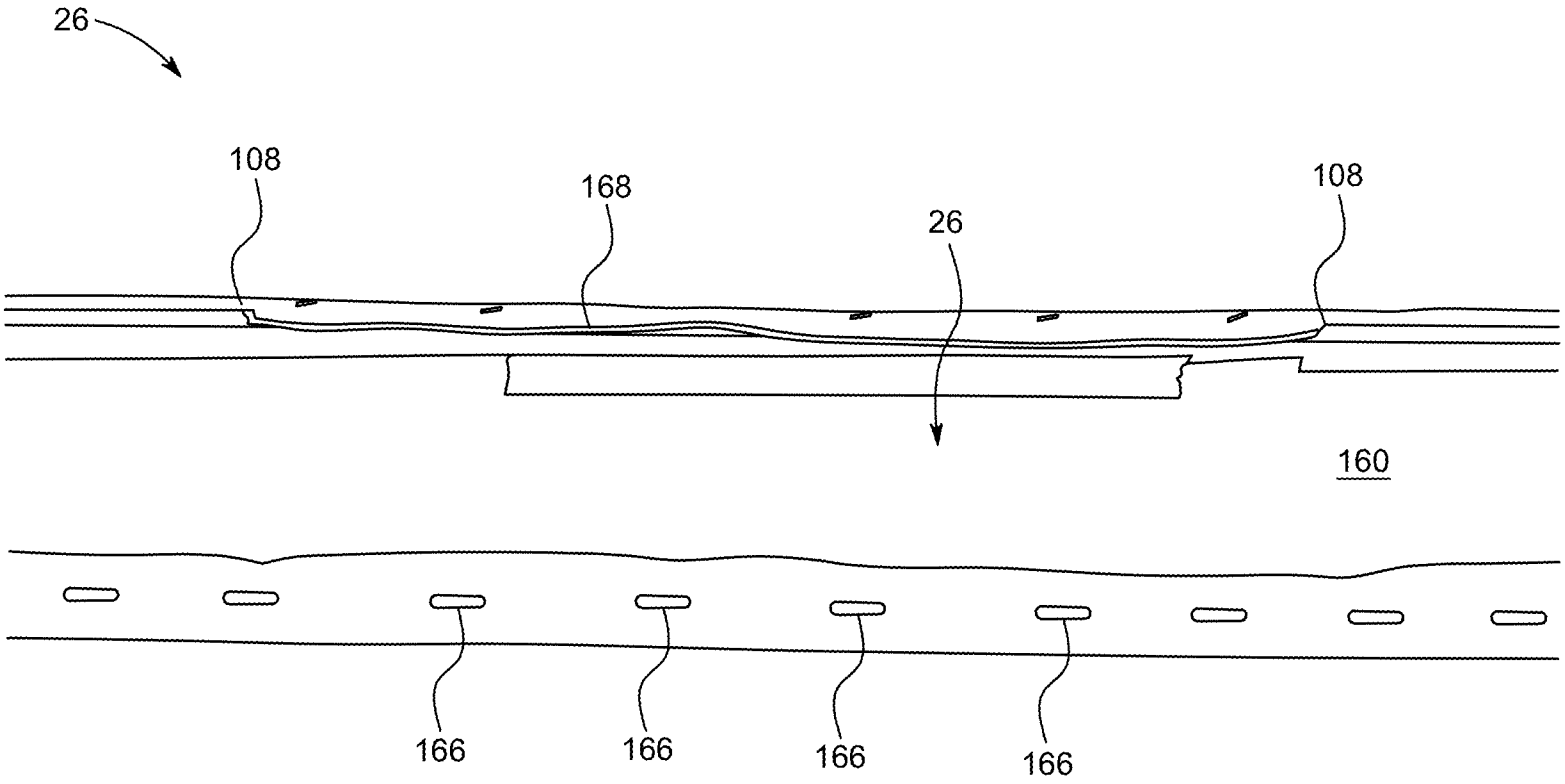
FIG. 19 is a perspective view of the back surface of a valance, the view showing covering material stapled to the valance, the view showing the clip feature, with the clip feature removed adjacent the center of the valance so as to allow the valance to be bent or folded to fit into the shipping container.
Figure 20:
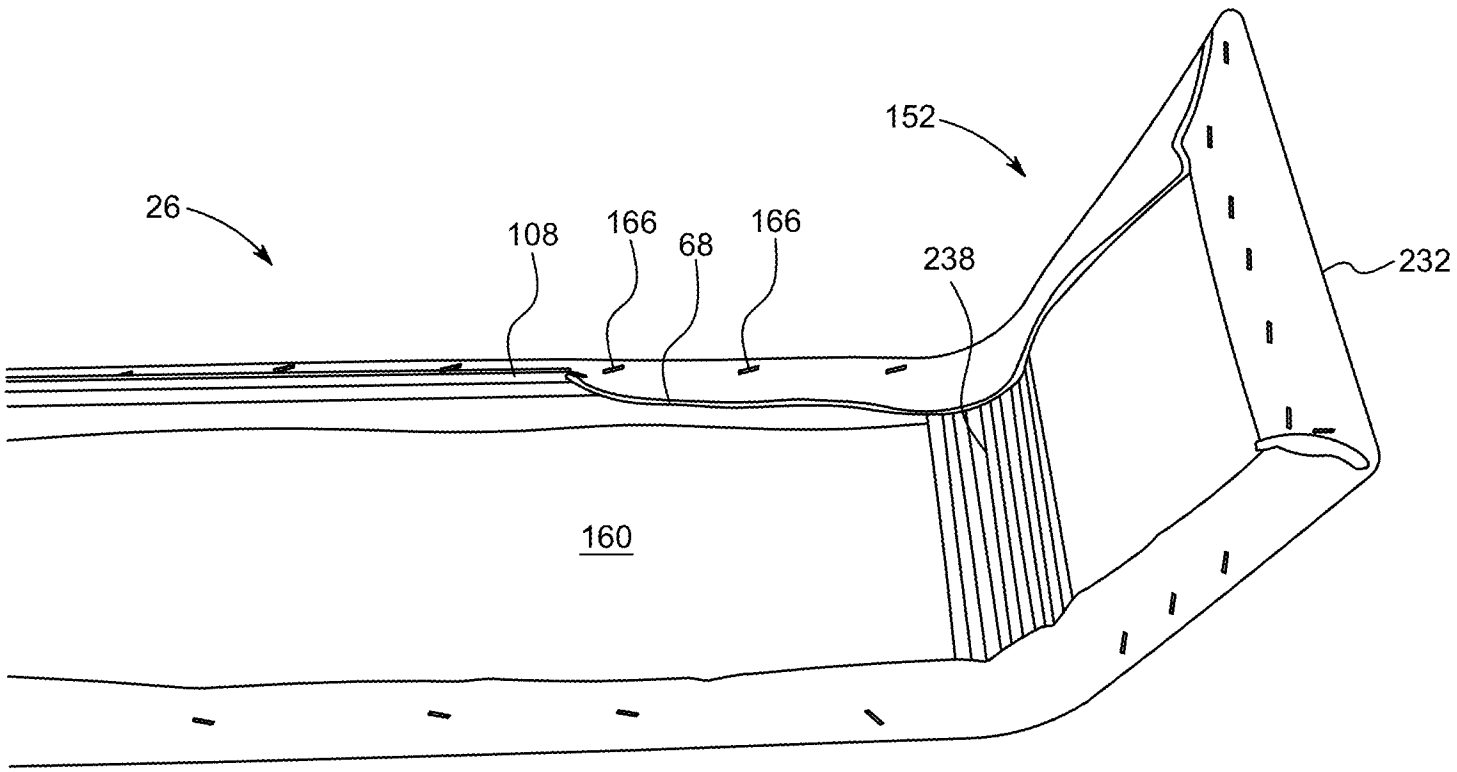
FIG. 20 is a perspective view of the back surface of a valance, the view showing covering material stapled to the valance, the view showing the clip feature, the view showing the end cap bent around a living hinge area.
Figure 21:
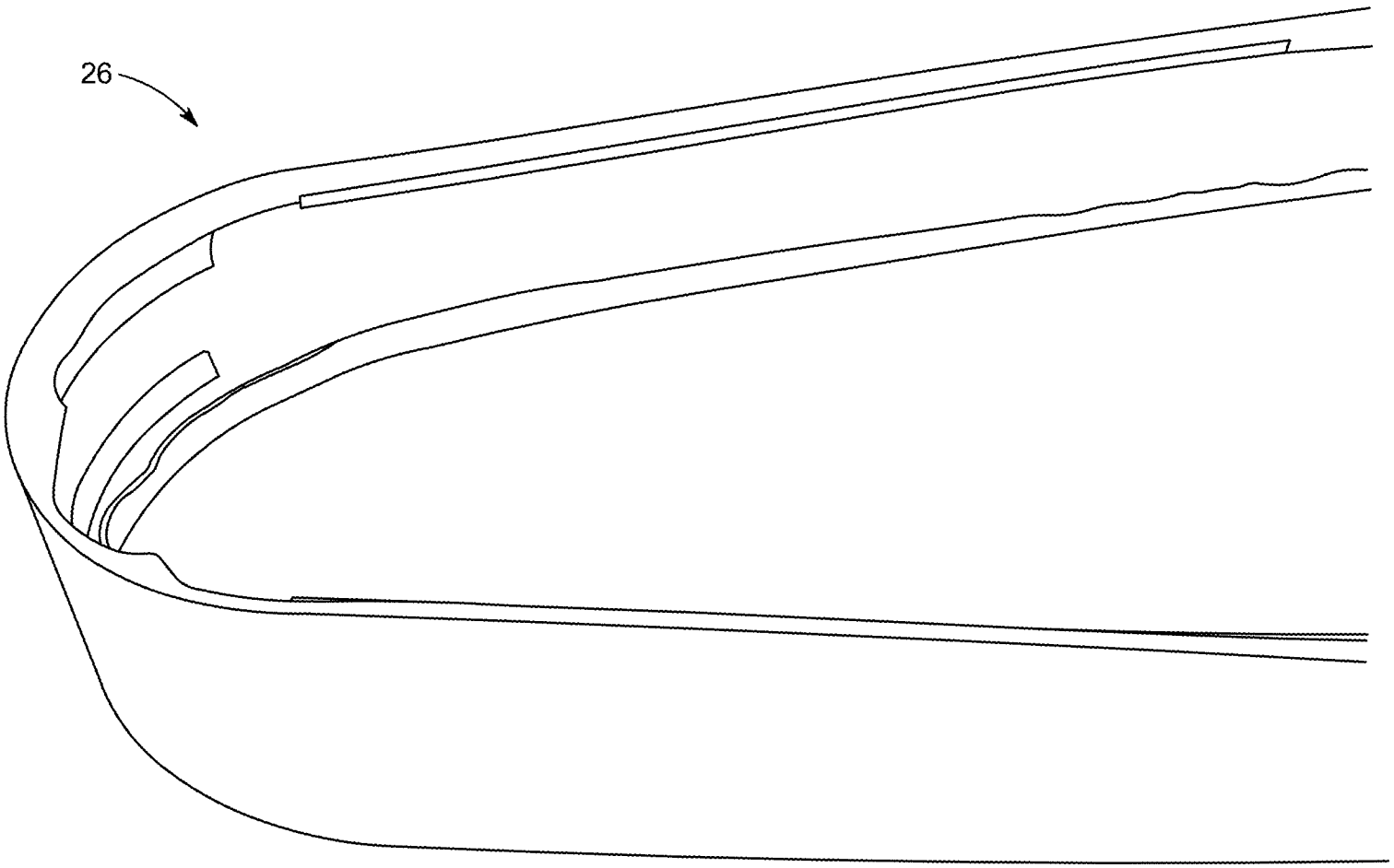
FIG. 21 is a perspective view of a valance, the view showing covering material stapled to the valance, the view showing the clip feature, with the clip feature removed adjacent the center of the valance, the view showing the valance bent or folded to fit into the shipping container.
Figure 22:
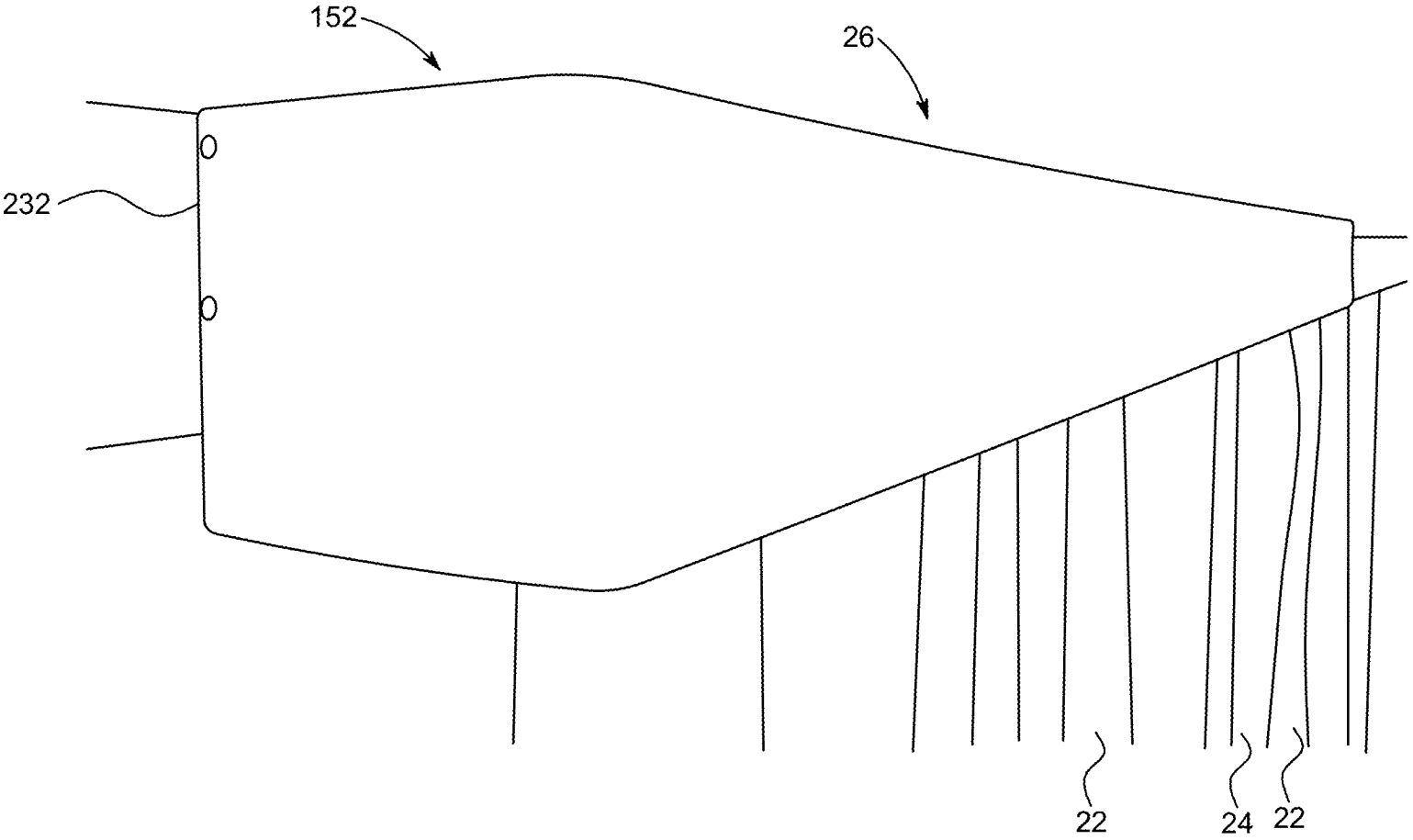
FIG. 22 is a perspective view of the end of a valance system, the view showing the valance covered by covering material, the view showing the end cap bent at the end of the valance, the view showing shade material hanging down from the track.
Figure 23:
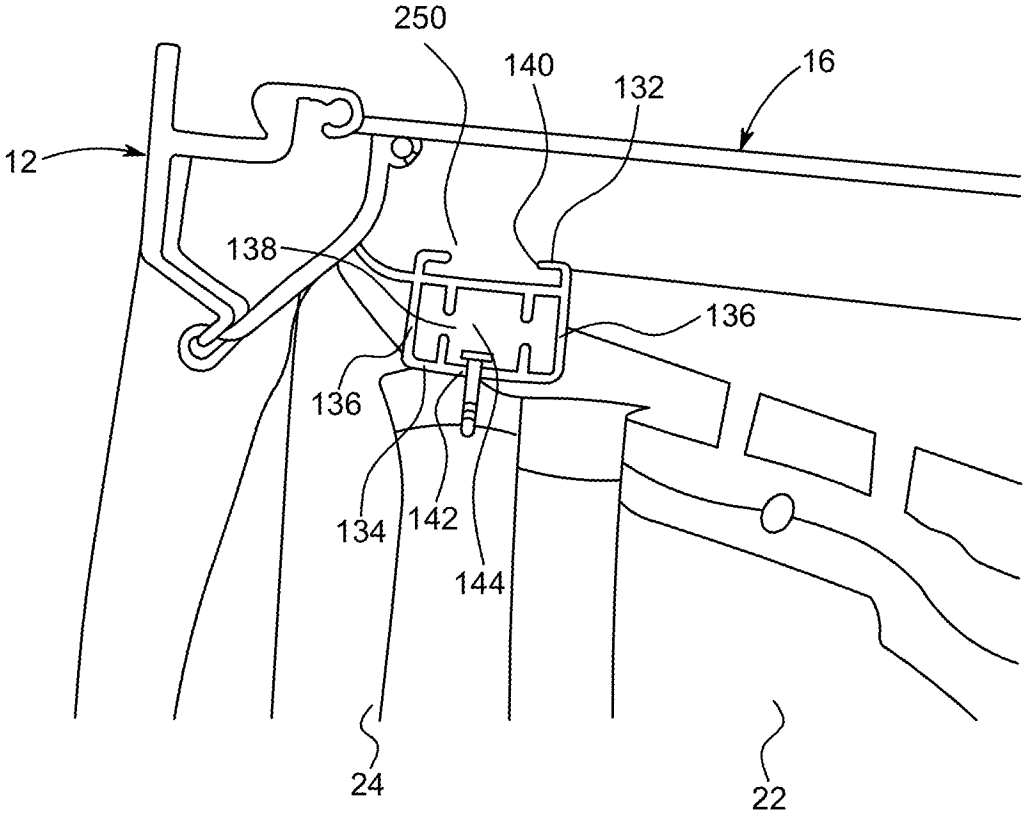
FIG. 23 is a side elevation view of a valance system, the view showing the wall bracket connected to a wall, a dual track top bracket connected to the wall bracket, the view showing a first track and a second track connected to the top bracket, the view showing sheer shade material connected to the interior track by a plurality of carriers, and non-sheer or black-out shade material connected to the exterior track by a plurality of carriers.
Figure 24:
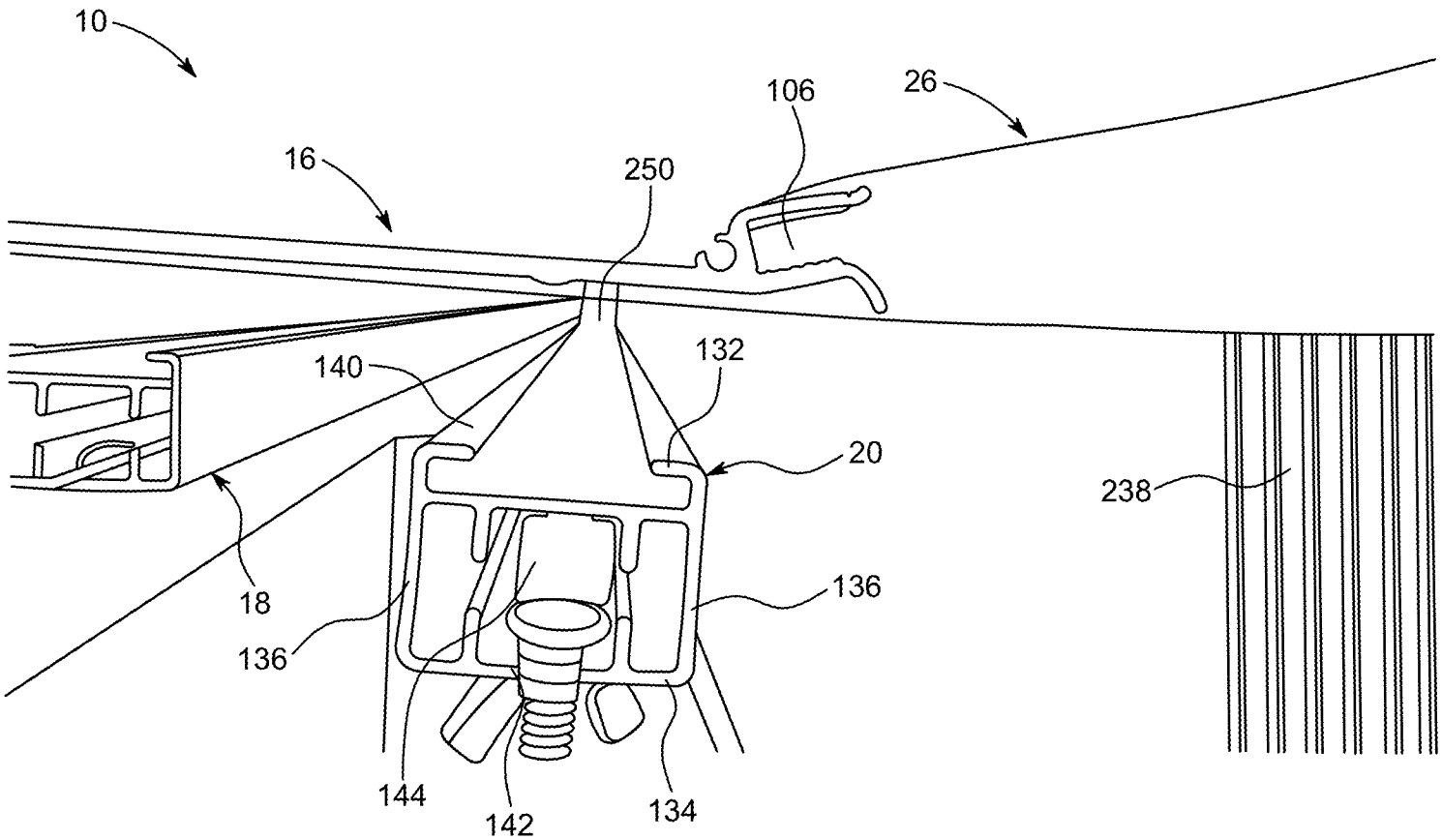
FIG. 24 is a side elevation view of a valance system, the view showing the wall bracket connected to a wall, a dual track top bracket connected to the wall bracket, the view showing a first track and a second track connected to the top bracket, the view showing sheer shade material connected to the interior track by a plurality of carriers, and non-sheer or black-out shade material connected to the exterior track by a plurality of carriers; the view showing a valance connected to a socket positioned in the end of the top bracket opposite the wall bracket, the view showing the clip feature positioned within the socket.
Figure 25:
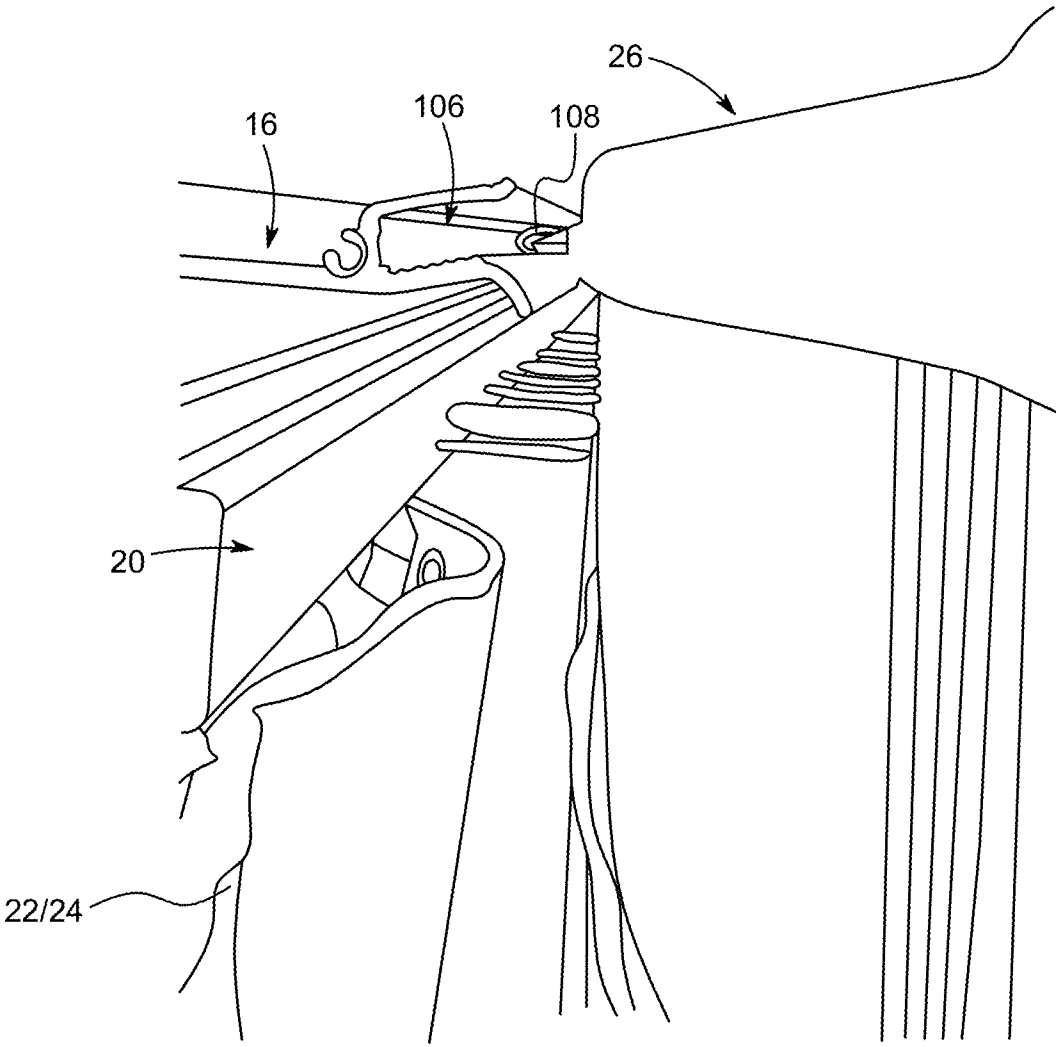
FIG. 25 is a side elevation view of a valance system, the view showing the wall bracket connected to a wall, a dual track top bracket connected to the wall bracket, the view showing a first track and a second track connected to the top bracket, the view showing sheer shade material connected to the interior track by a plurality of carriers, and non-sheer or black-out shade material connected to the exterior track by a plurality of carriers; the view showing a valance connected to a socket positioned in the end of the top bracket opposite the wall bracket, the view showing the clip feature positioned within the socket.
Figure 26:
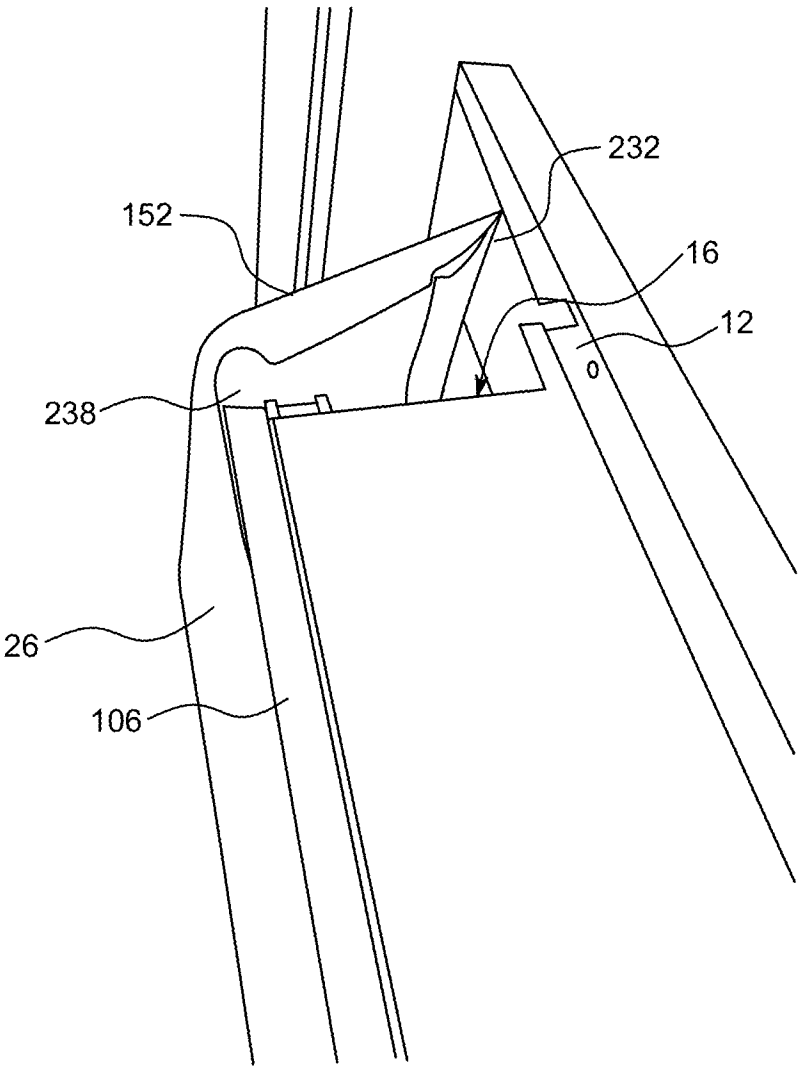
FIG. 26 is a top perspective view of the end of a valance system, the view showing the valance covered by covering material, the view showing the end cap bent at the end of the valance, the view showing shade material hanging down from the track.
Figure 27:
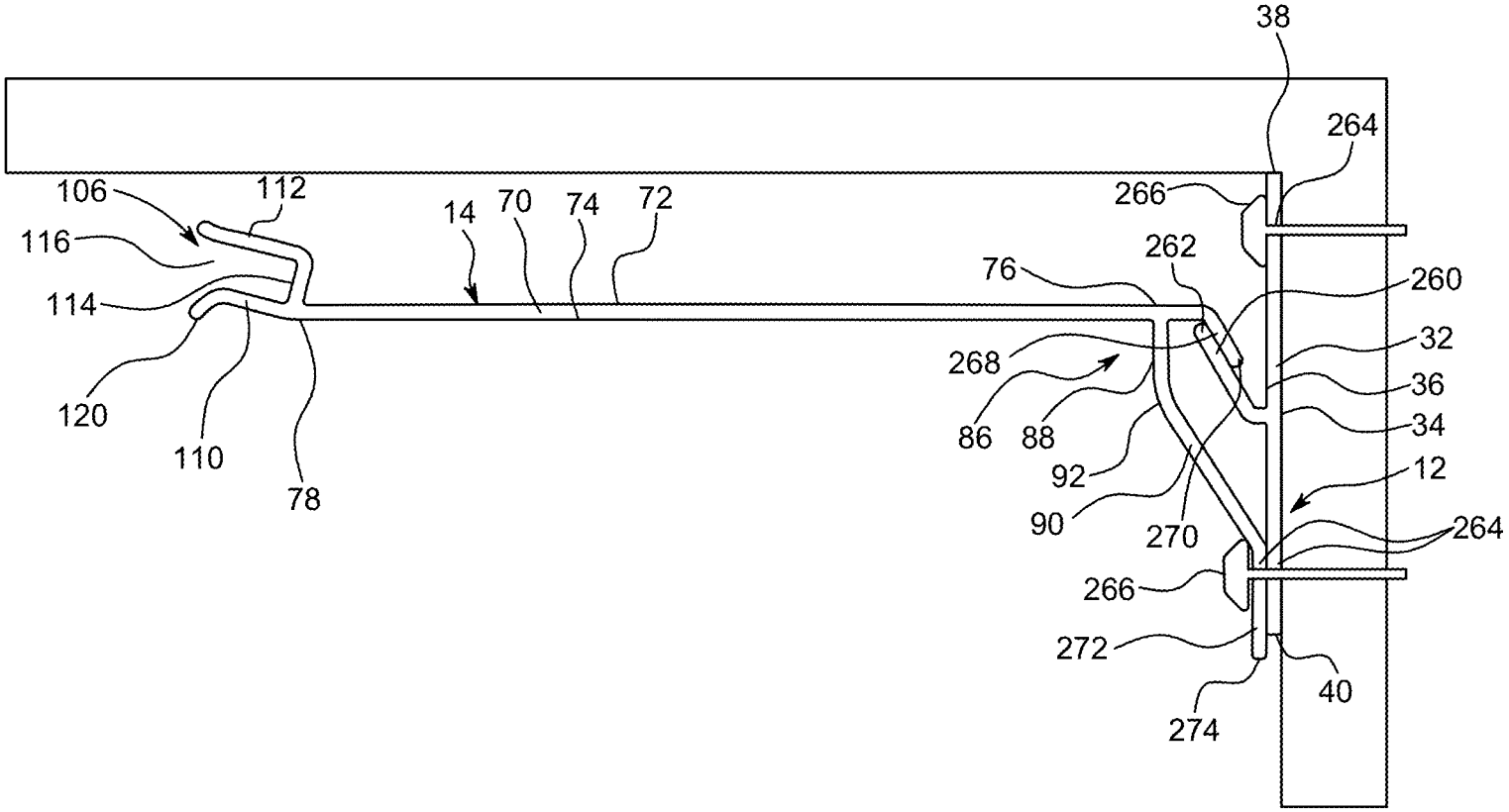
FIG. 27 is a side elevation view of an alternative design for wall bracket and top bracket, the view showing the wall bracket installed into the wall and in engagement with the ceiling and the top bracket positioned on the wall bracket.
Figure 28:
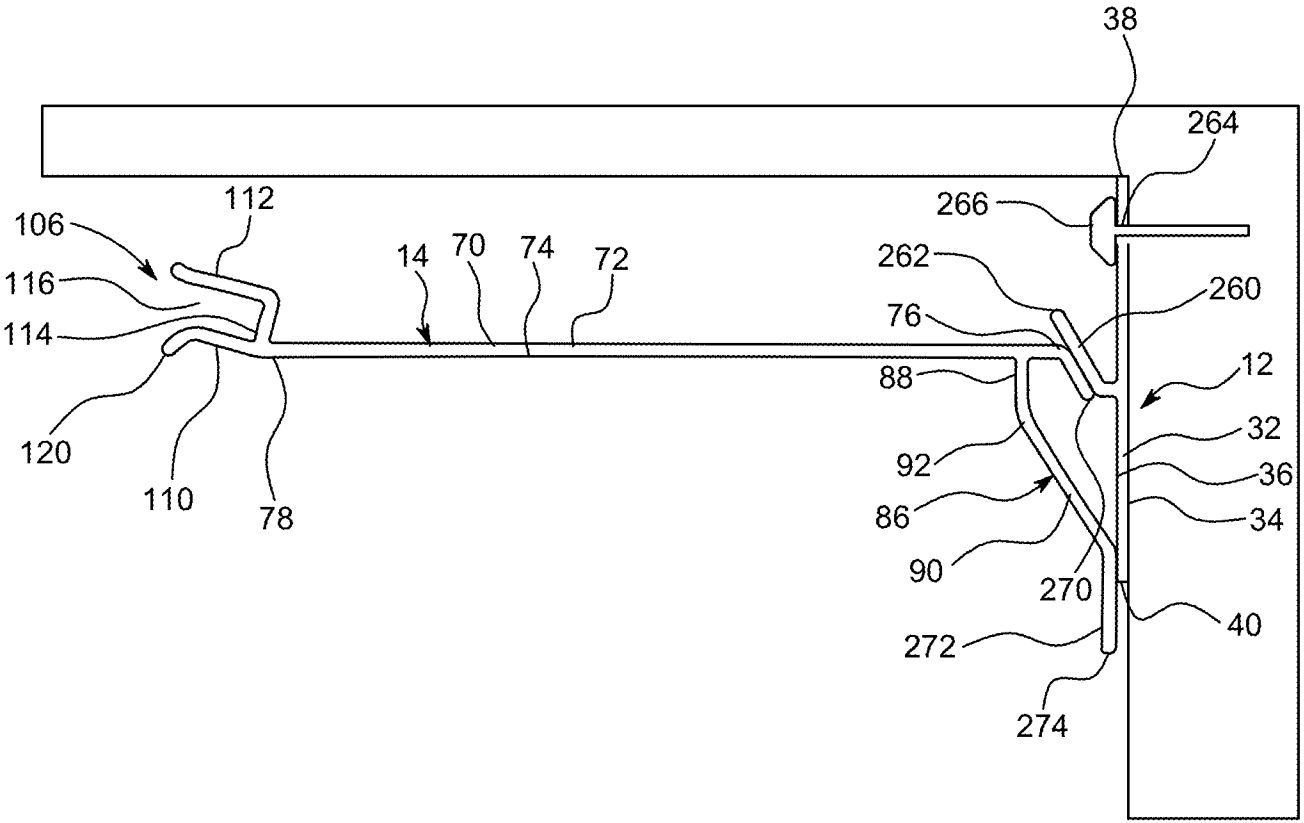
FIG. 28 is a side elevation view of an alternative design for wall bracket and top bracket, the view showing the top bracket being installed onto the wall bracket with the first arm of the top bracket in engagement with and sliding upward upon the first arm of the wall bracket.
Figure 29:
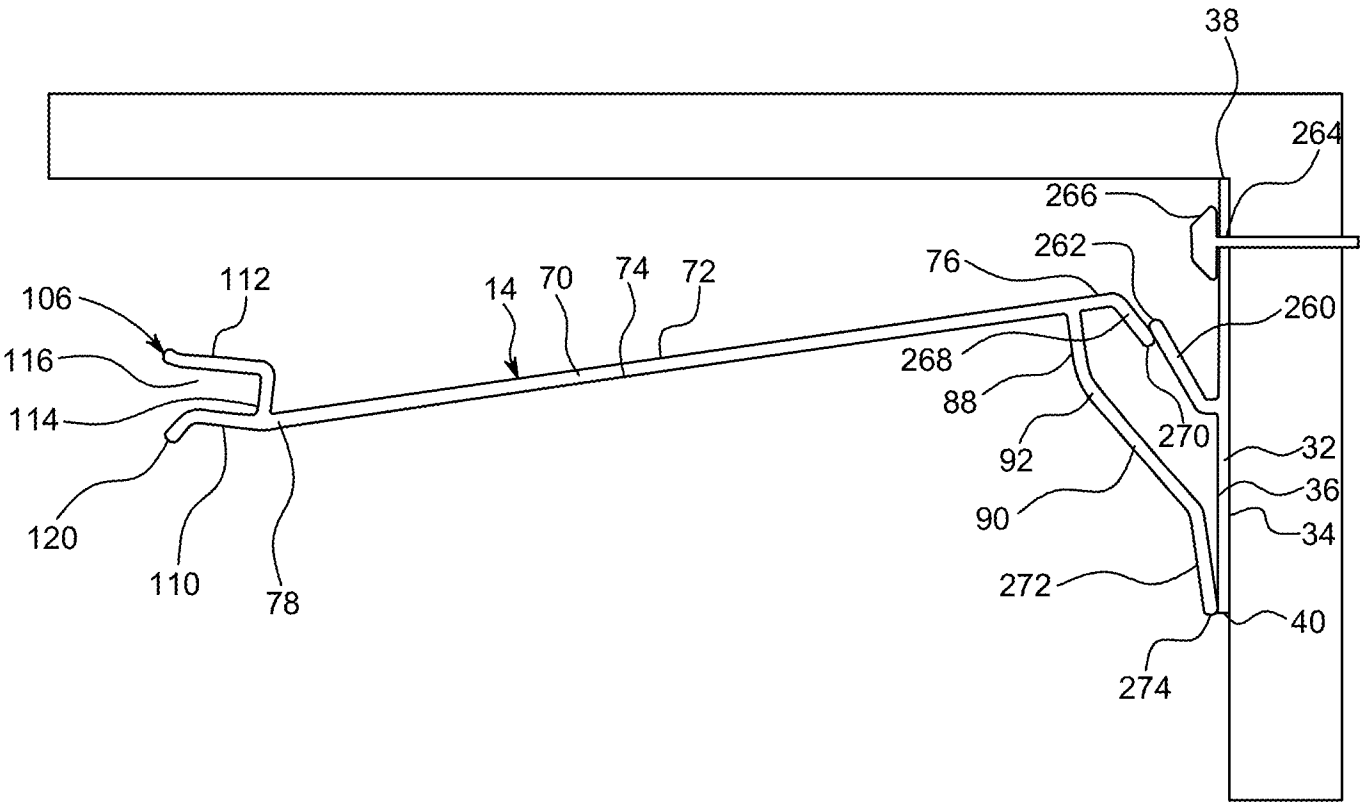
FIG. 29 is a side elevation view of an alternative design for wall bracket and top bracket, the view showing the top bracket being installed onto the wall bracket with the first arm of the top bracket in engagement with and just about to pass over the upper end of the first arm of the wall bracket, the view showing the forward end of the top bracket tipped downward.
Figure 30:
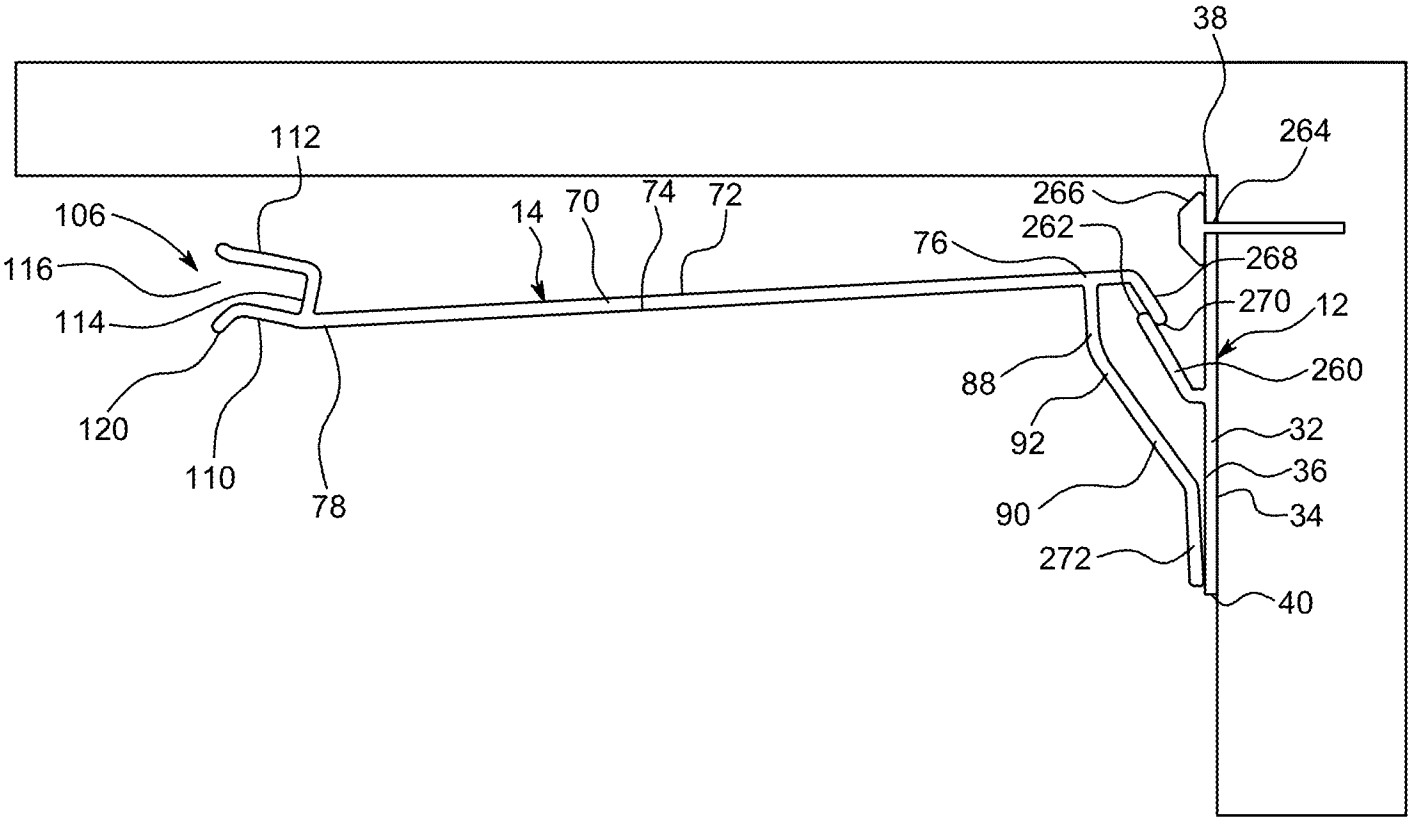
FIG. 30 is a side elevation view of an alternative design for wall bracket and top bracket, the view showing the top bracket being installed onto the wall bracket with the first arm of the top bracket in engagement with and just passed over the upper end of the first arm of the wall bracket, the view showing the forward end of the top bracket tipped downward and the top bracket about to slide downward onto the wall bracket.
Figure 31:
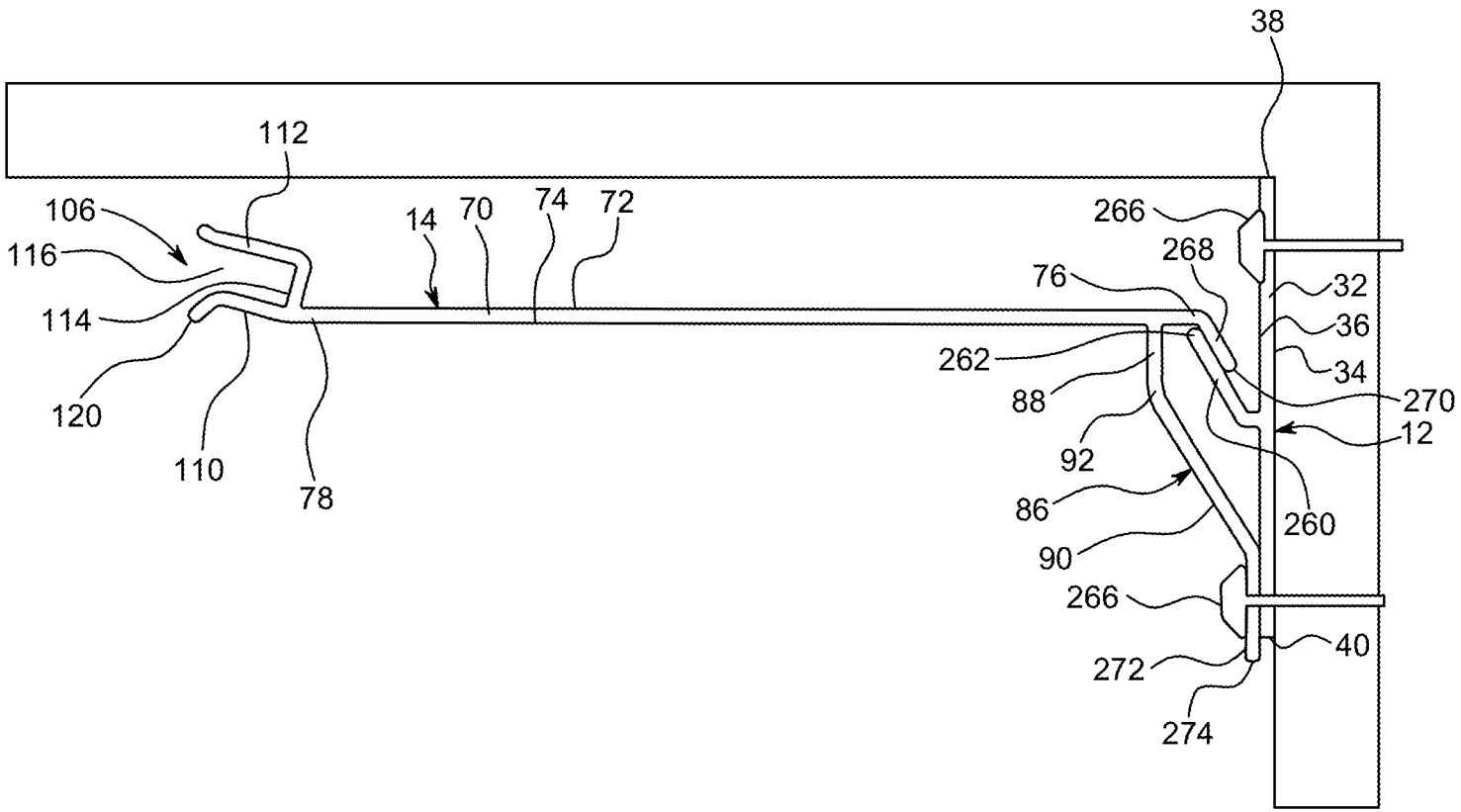
FIG. 31 is a side elevation view of an alternative design for wall bracket and top bracket, the view showing the top bracket installed onto the wall bracket with the first arm of the top bracket in engagement with and over the first arm of the wall bracket, the view showing the support foot of the top bracket fastened to the wall through the lower end of the wall bracket.
Figure 32:
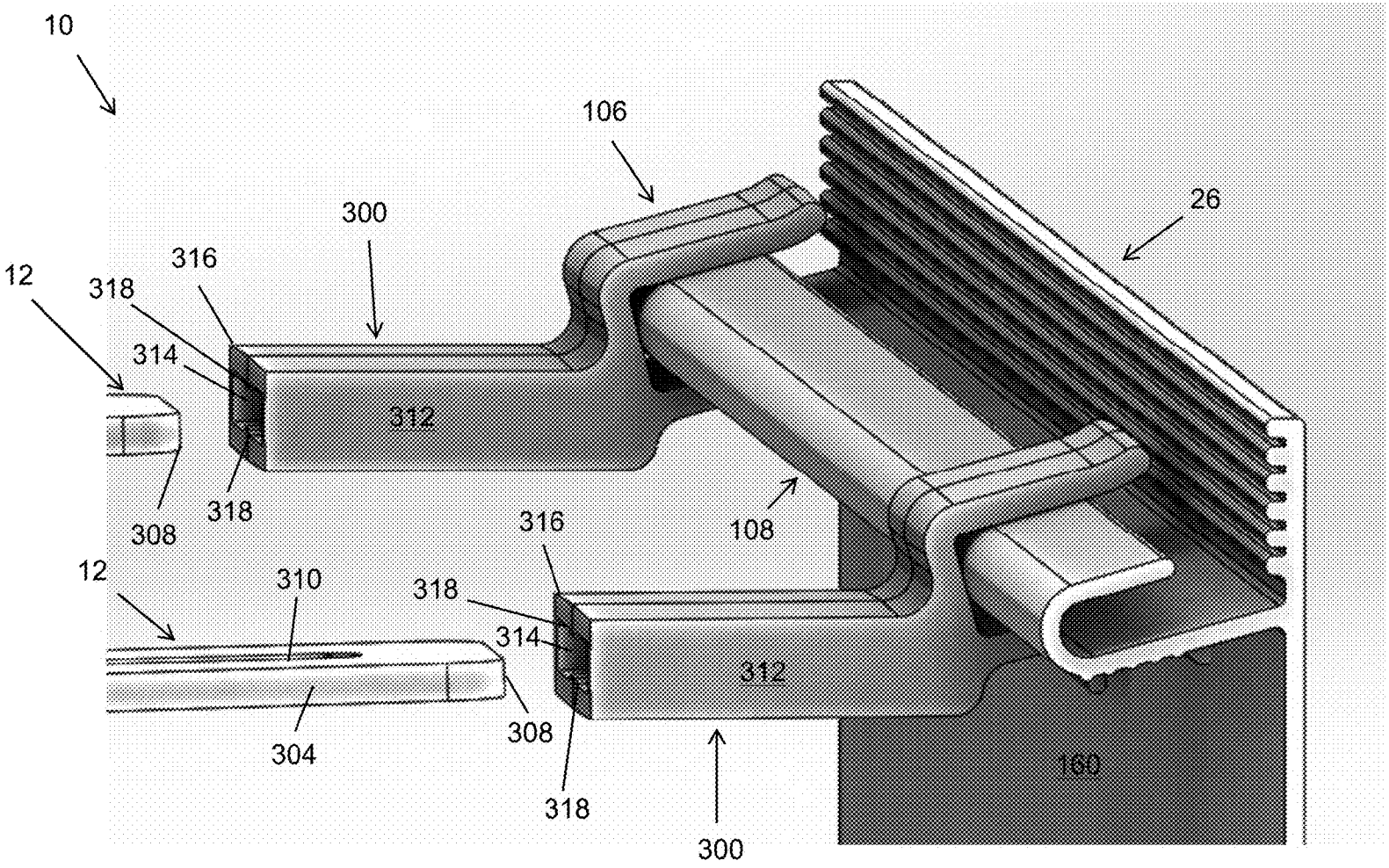
FIG. 32 is a perspective view of the valance system, the view showing the wall brackets and the clips unattached, the view showing the sockets and the clip feature attached.
Figure 33:
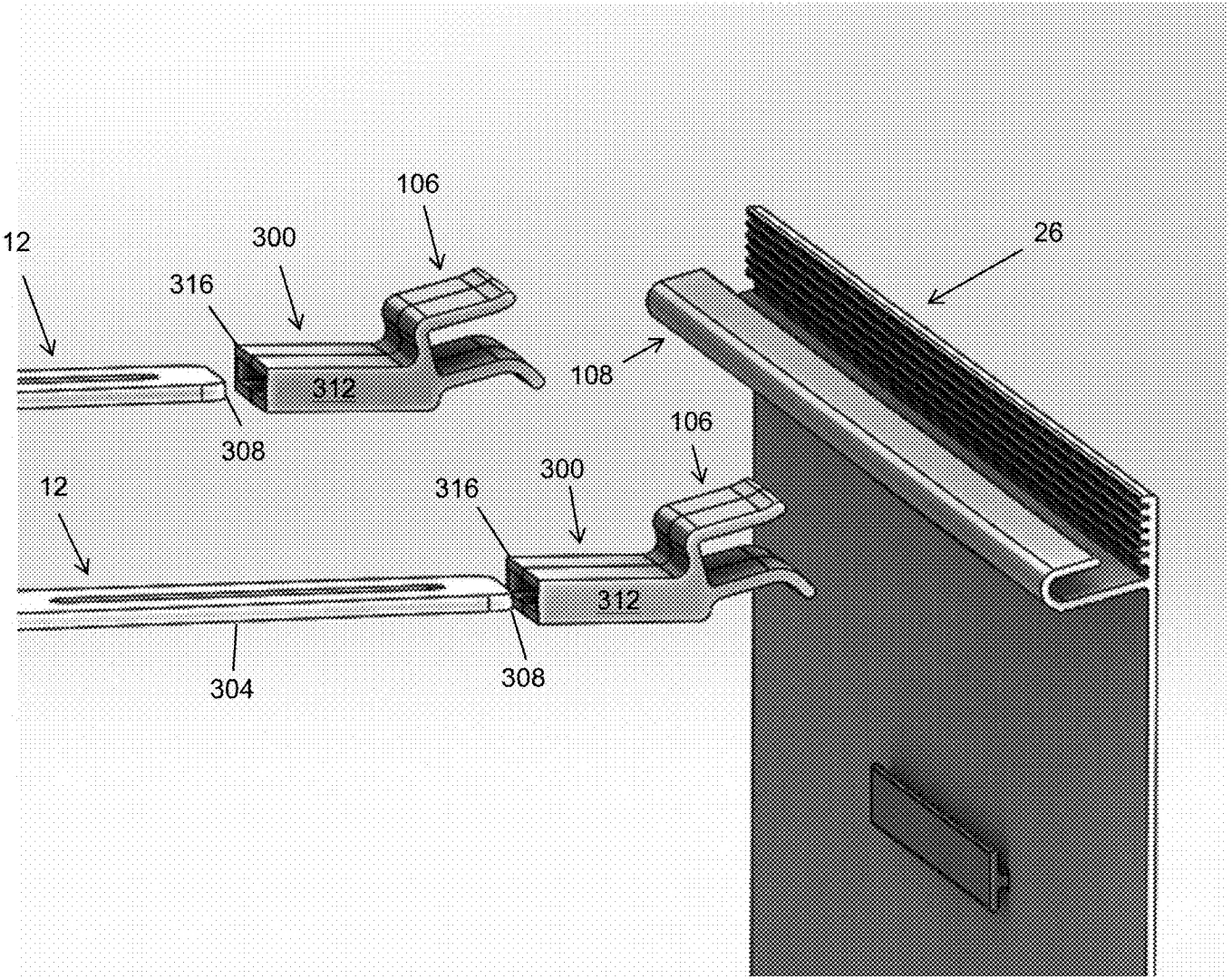
FIG. 33 is a perspective view of the valance system, the view showing the wall brackets and the clips unattached, the view showing the sockets and the clip feature unattached.
Figure 34:
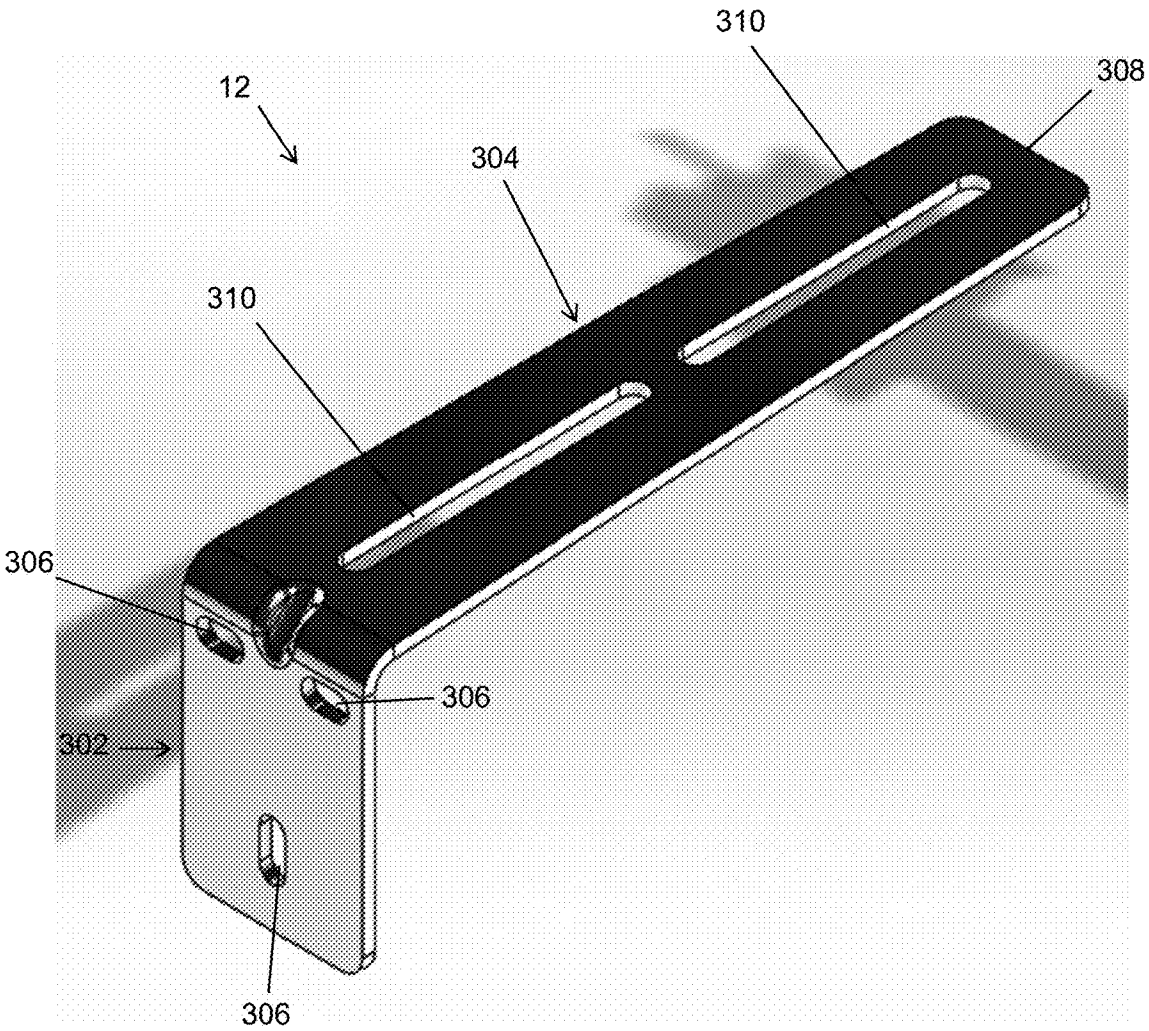
FIG. 34 is a perspective view of a wall bracket.
Figure 35:
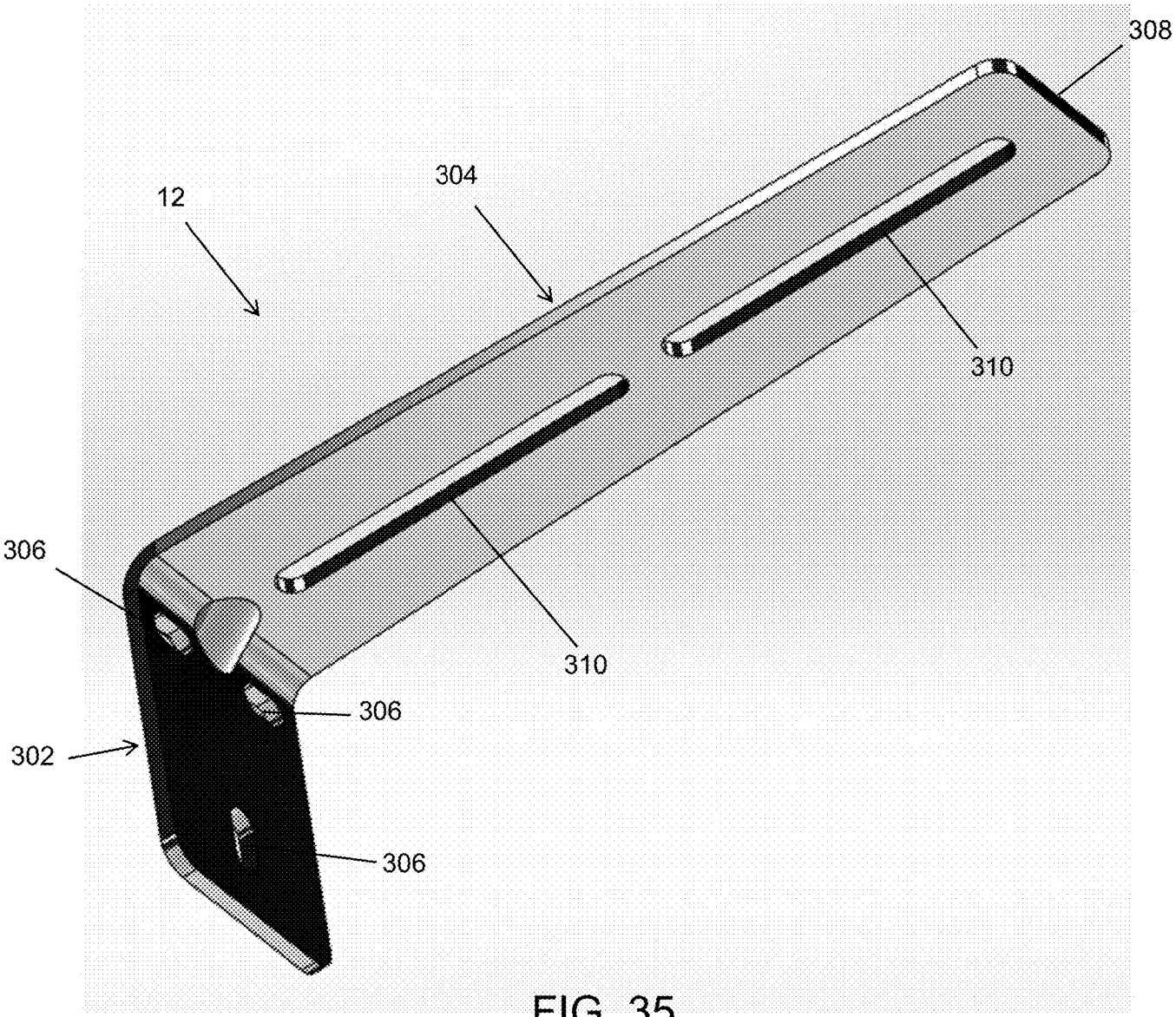
FIG. 35 is a rear elevation view of a wall bracket.
Figure 36:
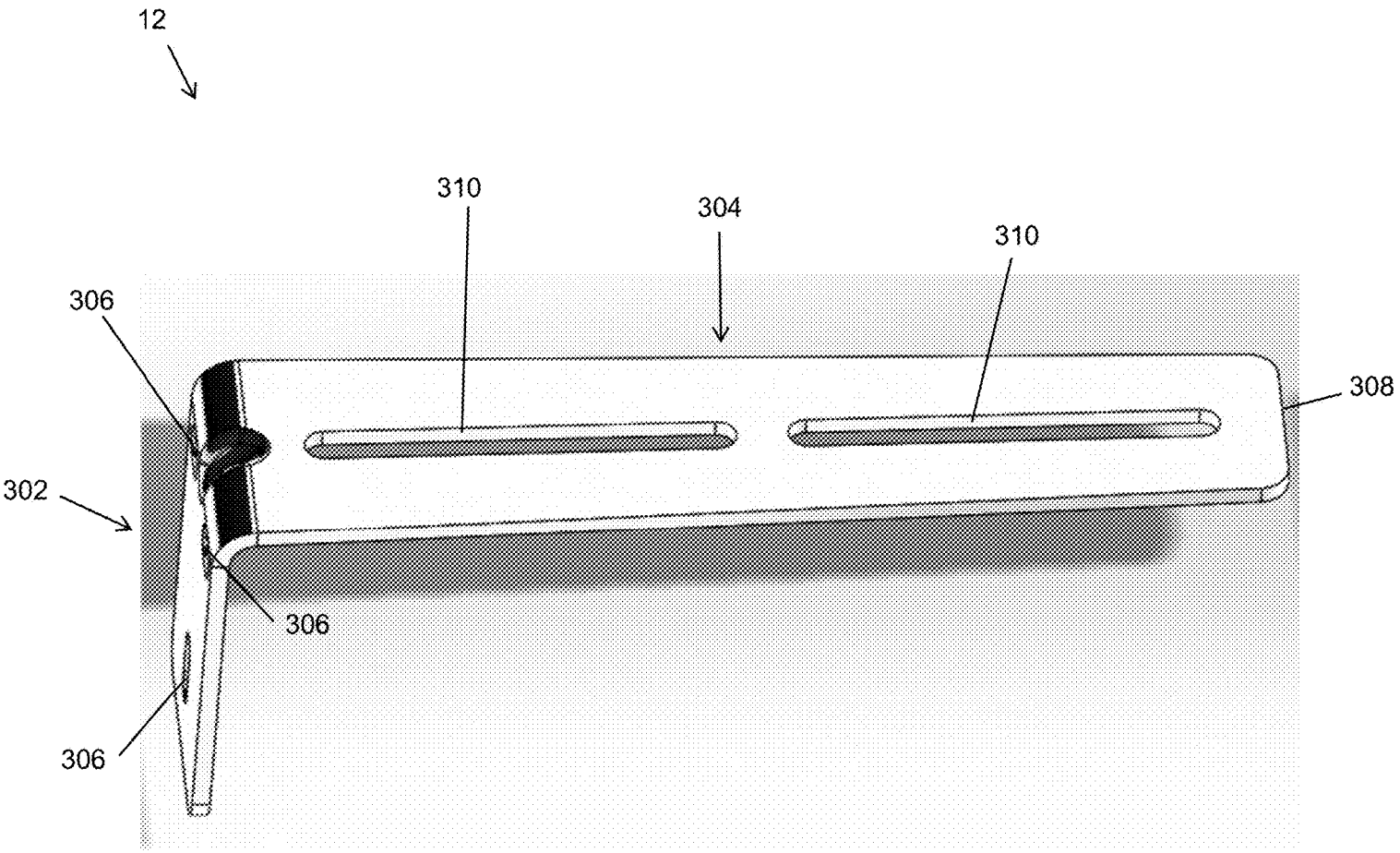
FIG. 36 is a top perspective view of a wall bracket.
Figure 37:
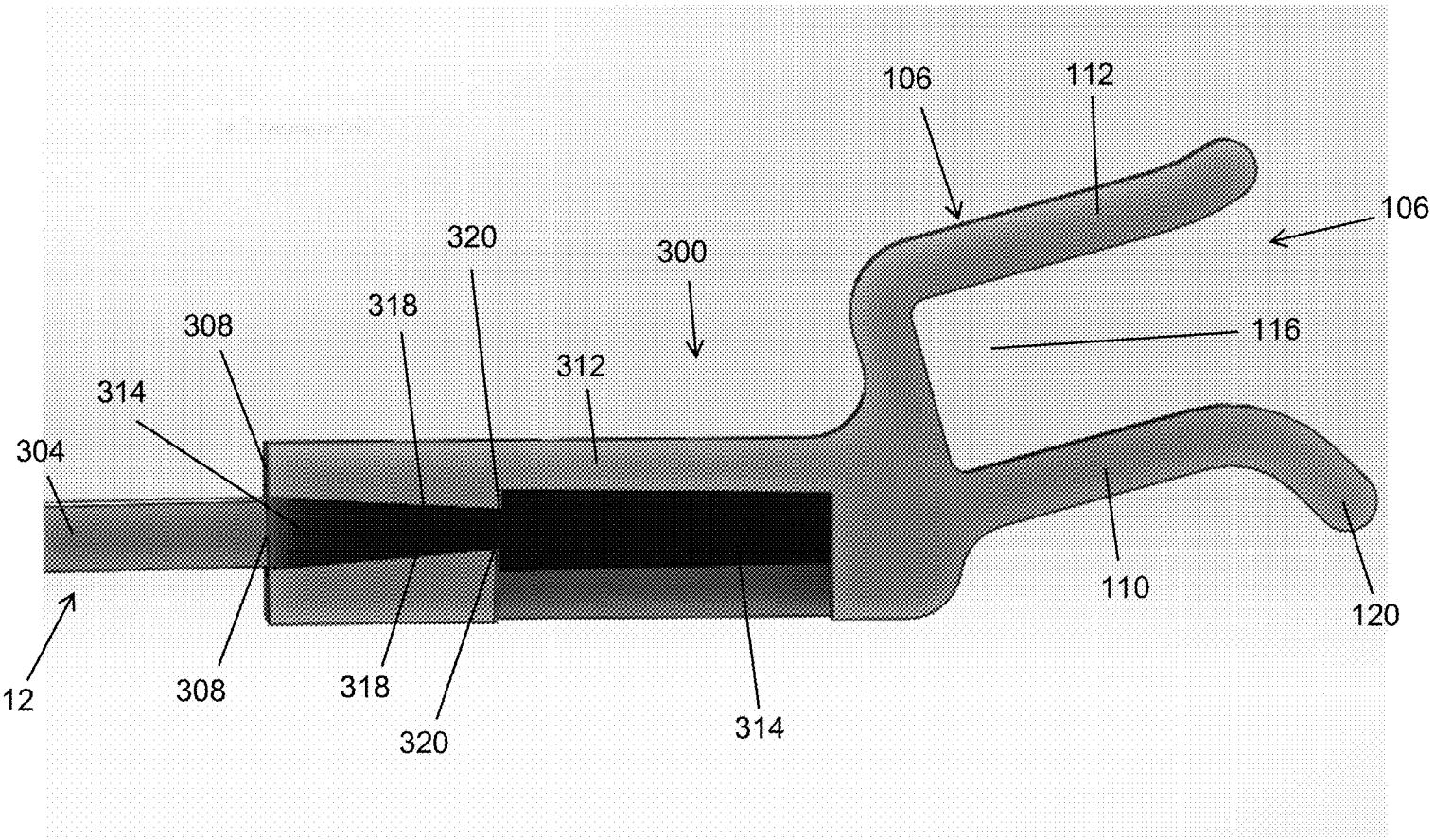
FIG. 37 is a side elevation view of a wall bracket connected to a clip.
Figure 38:
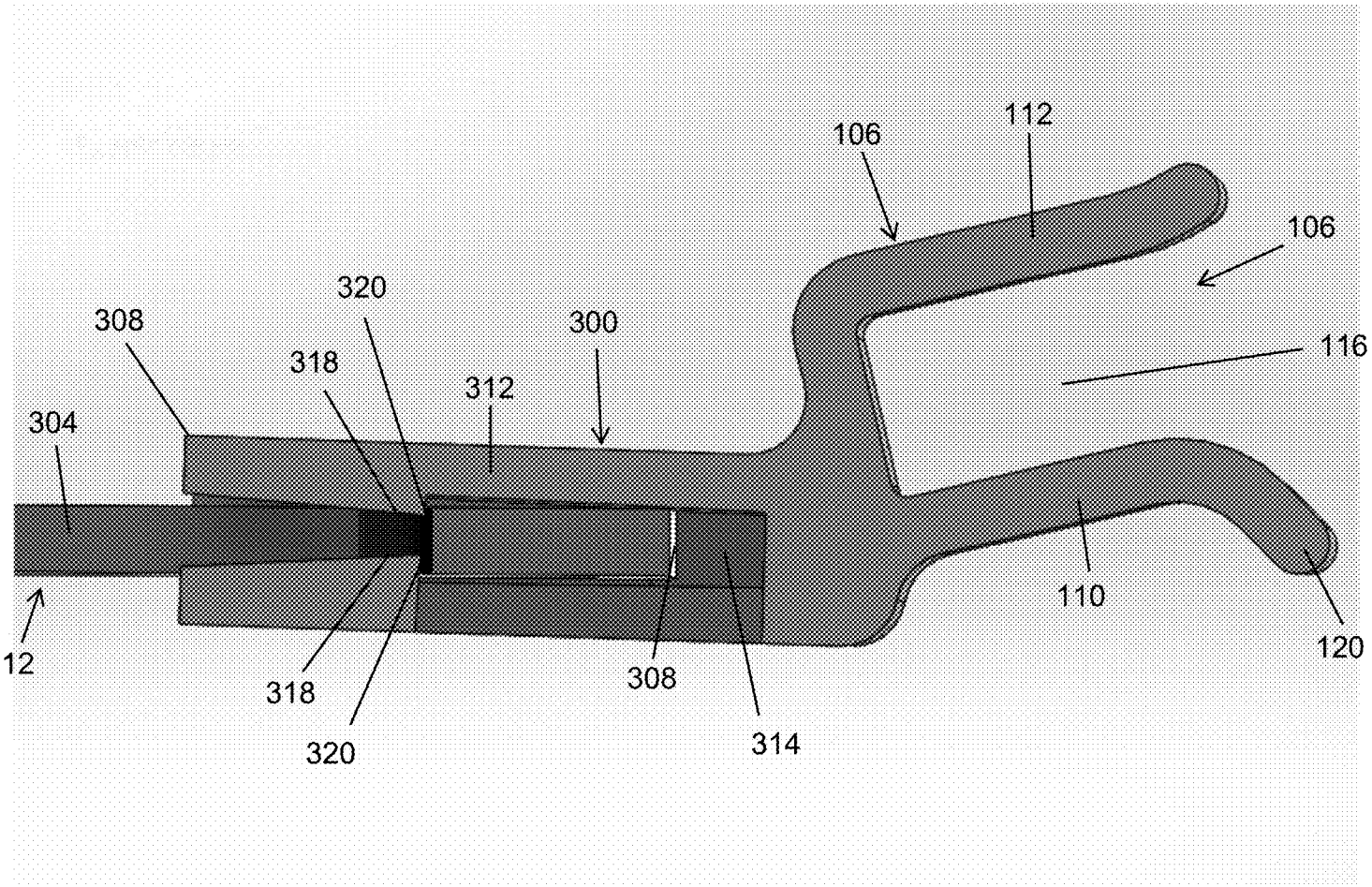
FIG. 38 is a side elevation view of a wall bracket connected to a clip.

While the clip feature 108 has been removed in one continuous extended centrally located position in FIGS. 19 and 21, it is hereby contemplated that a plurality of smaller sections of clip feature 108 may be removed where the bend is desired. This arrangement allows for bending of the valance 26 while also allowing for a portion of the area of valance 26 that was bent to be held within socket 106 upon installation. This arrangement helps to prevent or smooth out any bulges or memory within the valance 26 upon installation.

Stiffener: When valance 26 is bent to fit within the shipping box, valance 26 has a tendency to have some memory, or to retain some bend within the valance 26 even after installation. To help correct or eliminate this bend, a stiffener 280 is added. Stiffener 280 is any object or device that can be added to valance 26 that helps to return the bent portion of valance 26 to a generally flat arrangement.

In one arrangement, stiffener 280 is a generally elongated piece of metal, wood, plastic, composite or other generally stiff and rigid material. In one arrangement, as is shown, stiffener 280 is generally rectangular in shape and is sized and shaped to fit within and slide within the slots formed by center arm 184 and upper arm 180 and/or center arm 184 and lower arm 182.

Once the stiffener 280 is inserted between the center arm 184 and upper arm 180 or center arm 184 and lower arm 182, the stiffener is slid into the position where the deflection or bend is present. As the stiffener 280 is flat and straight, once slid into position, stiffener 280 has a tendency to take out any or most unintended deflection or bend in the valance 26.

In an alternative arrangement, stiffener 280 is installed by any other manner or means onto the valance 26 such as gluing, welding, adhering, stapling, taping, or the like.

Figure 17:
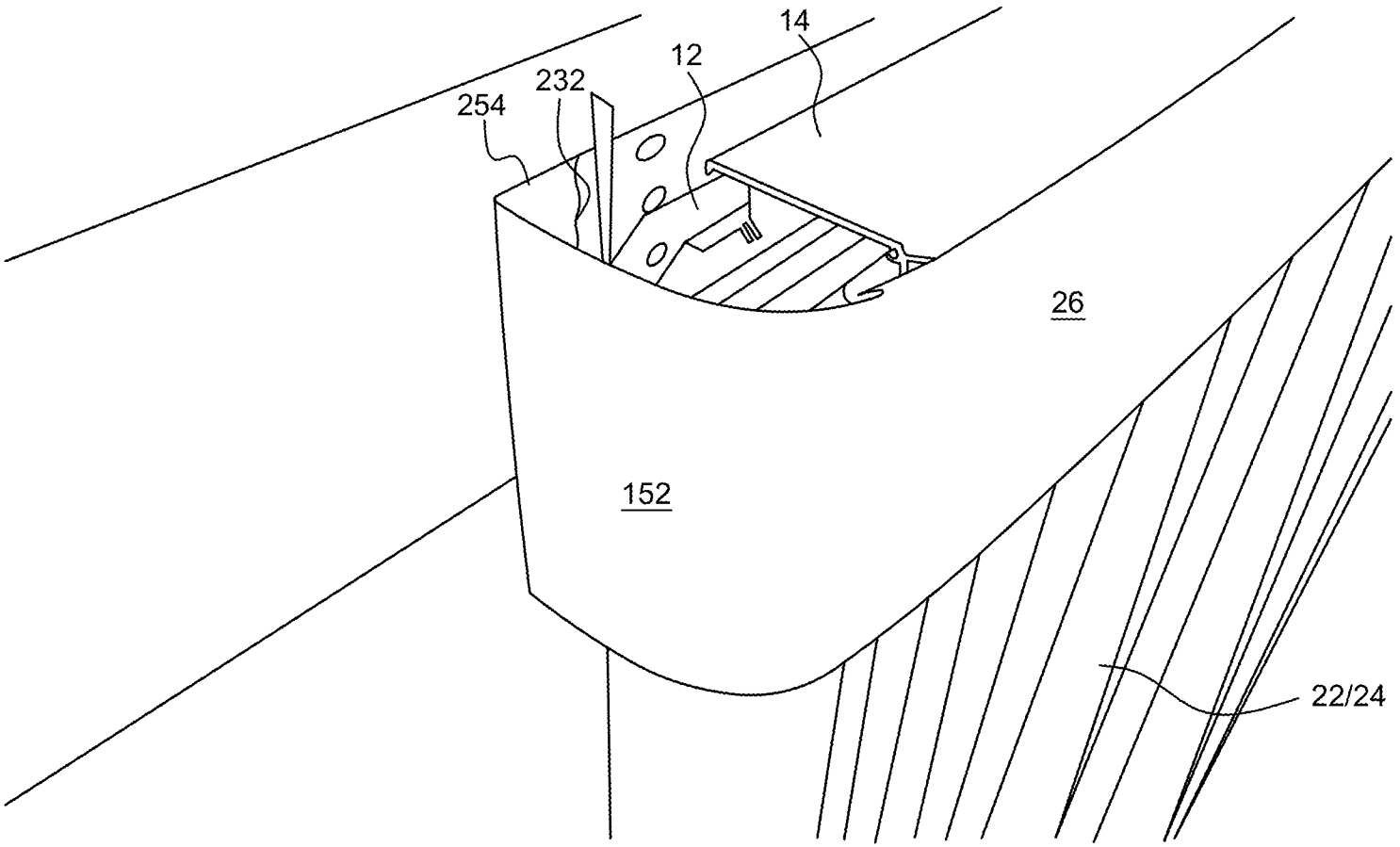
FIG. 17 is a perspective view of an assembled valance system; the view showing a wall bracket attached to a wall, a single track top plate, a track connected to the top plate, and a valance connected to the top plate.
Figure 18:
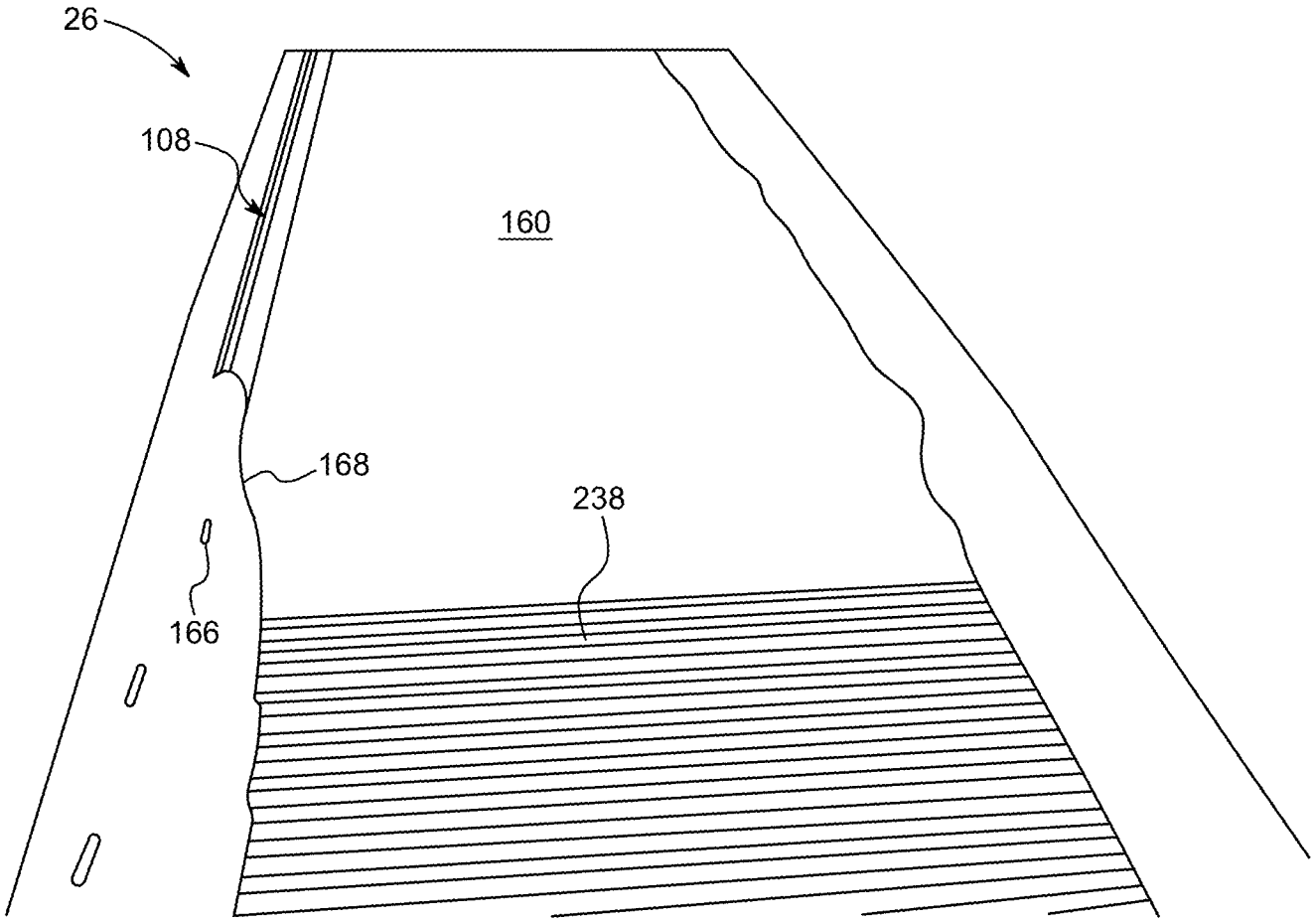
FIG. 18 is an end perspective view of the back surface of a valance, the view showing covering material stapled to the valance, the view showing the clip feature, the view showing the living hinge area of the end cap.

End Cap Configurations: As stated herein, end caps 152 can be curved by living hinges in hinge area 238 into any desired configuration desired by the user. These configurations include a sharp 90 degree corner, a smooth curve, an angled curve or any other configuration. In one arrangement, with reference to FIG. 17, the excess portion 254 of end cap 162, which is not consumed by the curve, is itself bent to travel along the wall and can be affixed thereto, thereby holding the outward ends 232 of end cap 152 to the wall or structure.

Alternative Arrangement of Wall Bracket and Top Bracket: With reference to FIGS. 27-31, an alternative arrangement of the wall bracket 12 and the top bracket 14 is presented. This arrangement is particularly well suited for situations where it is desired to place the top bracket 14 close to the ceiling, or as close to the ceiling as possible.

In the arrangement shown, wall bracket 12 includes a main body 32 that is generally rectangular in shape. Main body 32 extends horizontally between a generally flat rear wall 34 positioned in approximate parallel spaced alignment to a generally flat front wall 36. Main body 32 extends vertically between a generally flat upper wall 38, that extends in approximate perpendicular alignment to the rear wall 34 and front wall 36, and a lower end 40.

A first arm 260 is main body 32 and extends outward and upward at an angle from main body 32. First arm 260 terminates in an upper end 262 that is positioned a distance forward of forward wall 36.

In this arrangement, main body 32 includes a plurality of openings 264 that are sized and shaped to receive fasteners 266 therein that serve to connect wall bracket 12 to the wall or other structure.

In the arrangement shown, top bracket 14 (which can either be a single top bracket or a double top bracket and for simplicity's sake will be referred to as "top bracket 14" in this example). Top bracket 14 includes an upper wall 70 that is generally rectangular in shape and extends vertically between an upper surface 72 that is generally planar in shape and a lower surface 74 that is also generally planar in shape, with the upper surface 72 and the lower surface 74 positioned in approximate perpendicular alignment to one another. Upper wall 70 extends a distance between rearward end 76 and forward end 78.

Rearward end 76 of upper wall 70 includes a first arm 268 that extends downward and rearward at an angle from the rearward end 76 of upper wall 70. First arm 268 extends downward and rearward at an angle before terminating at lower end 270. First arm 268 extends at approximately the same angle as the first arm 260 of wall bracket 12, such that the two components are positioned in generally flat and flush mating engagement with one another when the top bracket 14 is placed on the wall bracket 12.

The forward end 78 of upper wall 70 includes the features described herein with respect to the socket 106 and related components.

The rearward end 76 of top bracket 14 includes a support arm 86. Support arm 86 is positioned forward a distance from rearward end 76. Support arm 86 includes a first section 88 that extends downward from the lower surface 74 of upper wall 70 a distance in approximately perpendicular alignment thereto. Support arm 86 includes a second section 90 that connects to first section 88 at corner section 92. Second section 90 angles rearward as it extends downward. Second section 90 connects to a support foot 272 that extends in approximate parallel spaced alignment to the forward wall 36 of wall bracket 12 when first arm 268 of top bracket 14 is in flat and flush engagement with the first arm 260 of wall bracket 12. Support foot 272 extends vertically a distance before terminating in a lower end 274. Like wall bracket 12, support foot 272 includes one or more openings 264 that receive fasteners 266 there through, as well as through main body 32 of wall bracket 12, thereby connecting the top bracket 14 and wall bracket 12 together while connecting both components 12, 14 to the wall or other structure.

Using this arrangement, the wall bracket 12 is mounted to the wall or other structure by placing the rear wall 34 of main body 32 of wall bracket 12 against the wall. The wall bracket 12 is slid along the wall until the upper wall 38 of the main body 32 engages the ceiling. That is, the wall bracket 12 is sized and shaped to eliminate measuring by indexing off of the intersection between the wall and the ceiling. When the upper wall 38 is engaged with the ceiling and the rear wall 34 is engaged with the wall, one or more fasteners are inserted through the openings 264 in the upper portion of main body 32, above the first arm 260.

Once the wall bracket 12 is installed, the top bracket 14 is installed onto the wall bracket 12. To do this, the rearward end 76 of top bracket 14 is placed along the wall and slid upward until the first arm 268 of top bracket 14 engages the first arm 260 of wall bracket 12. Due to the downward and rearward angle of the first arm 268 of top bracket 14 and the outward and upward angle of the first arm 260 of wall bracket 12, the first arm 268 of top bracket 14 has a tendency to be guided or slide upward along the first arm 260 of wall bracket 12. This continues until the lower end 270 of the first arm 268 of top bracket 14 passes above the upper end 262 of first arm 260 of wall bracket 12. Once this occurs, the first arm 268 of top bracket 14 is moved behind the first arm 260 of the wall bracket 12 and then the top bracket 14 is lowered into place. As the top bracket 14 slides upward on the wall bracket 12, the forward angle of the first arm 260 of the wall bracket 12 has a tendency to cause the forward end 78 of top bracket 12 to angle downward. This downward angling of top bracket 14 provides needed clearance between the forward end 78 of top bracket 14 and the ceiling during the installation process.

Once lowered into place the forward and lower surface of first arm 268 of top bracket 14 is in generally flat and flush engagement with the rearward and upper surface of first arm 260 of wall bracket 12. In addition, once lowered into place, the rearward surface of support foot 272 of top bracket 14 is in generally flat and flush engagement with the forward surface 36 of the lower end of main body 32. Once in this position, one or more fasteners are passed through openings 264 of both the support foot 272 and the main body 32 thereby connecting and holding the top bracket 14 onto the wall bracket 12 and preventing unintentional disengagement of the two components.

In this arrangement, the upper end of socket 106 is positioned at the appropriate spacing from the ceiling without any measuring. Once the wall bracket 12 and the top bracket 14 are installed, as is described herein, the valance 26 is installed, as is described herein.

From the above discussion and the accompanying drawings and claims it will be appreciated that the improved valance system for window coverings presented offers many advantages over the prior art. That is, the system presented: improves upon the state of the art; has a pleasing aesthetic appearance; is easy to install; is easy to remove; is easy to cover; is easy to ship; can be folded for shipping; can be shipped in the same shipping box as a broken down track system; does not require a shipping box that is longer than a broken down track system; can be installed quickly; can be replaced quickly; is easy to cover with material; is formed of a minimum number of parts; is relatively inexpensive; has a long useful life; is easily customized; can be easily cut to size; can be used in most applications; is standardized; allows for customized end caps; uses a minimum amount of material; is lightweight; is durable; has a long useful life; can be easily extended; utilizes and end cap that can be configured in a number of ways, among countless other improvements and advantages.

It will be appreciated by those skilled in the art that other various modifications could be made to the device without parting from the spirit and scope of this invention. All such modifications and changes fall within the scope of the claims and are intended to be covered thereby. It should be understood that the examples and embodiments described herein are for illustrative purposes only and that various modifications or changes in light thereof will be suggested to persons skilled in the art and are to be included within the spirit and purview of this application.

What is claimed is:

1. A valance system, comprising:

a top bracket extending a length between opposing ends;

the top bracket extending between a rearward end and a forward end;

shade material operatively connected to the top bracket;

the top bracket having an upper wall and a lower wall at the forward end, the upper wall and the lower wall forming a socket positioned in the forward end, the upper wall and the lower wall being angled so that the upper wall and the lower wall extend slightly downward as they extend rearward;

a valance having a forward side and a rearward side and extending a length between opposing ends;

the valance having a clip feature extending outward from the rearward side of the valance;

wherein the clip feature is sized and shaped to frictionally fit within the socket of the top bracket;

wherein the valance is installed onto the top bracket by pressing the clip feature of the valance into the socket of the top bracket;

wherein the lower wall includes a flange that extends slightly outward and downward and contacts the side of the valance below the clip feature.

2. The system of claim 1, wherein the valance is configured to be removed from the top bracket by pulling the clip feature of the valance out of the socket of the top bracket.

3. The system of claim 1, wherein the valance is formed of a single continuous uninterrupted piece.

4. The system of claim 1, wherein portions of the valance is bent for shipping and the clip feature is removed in areas where the valance is bent for shipping.

5. The system of claim 1, wherein the valance converts between a shipping configuration, wherein the valance is bent, and an installation configuration, wherein the valance is extended.

6. The system of claim 1, further comprising end caps connected to the opposing ends of the valance.

7. The system of claim 1, further comprising end caps, wherein the end caps include a hinge area that is configured to facilitate bending of the end caps.

8. The system of claim 1, wherein the clip feature includes friction members, and the socket includes friction members, wherein when the clip feature is inserted within the socket, the friction members of the clip feature engage the friction members of the socket.

9. The system of claim 1, wherein the clip feature is C-shaped or U-shaped when viewed from the side.

10. A valance system, comprising:

a valance extending a length between opposing ends;

the valance extending a height between an upper end and lower end;

the valance having a forward side and a rearward side;

the valance having a clip feature simultaneously extending outward and downward from the rearward side and extending between the opposing ends of the valance;

wherein the valance is bent;

wherein the bent valance is placed in a shipping box, thereby providing an easily shipped seamless and continuous valance;

a top bracket having a socket;

wherein the clip feature is configured to fit within the socket in the top bracket and to be frictionally held within the socket.

11. A valance system, comprising:

a valance extending a length between opposing ends;

the valance extending a height between an upper end and lower end;

the valance having a forward side and a rearward side;

the valance having a clip feature simultaneously extending outward and downward from the rearward side and extending between the opposing ends of the valance;

wherein the valance is bent;

wherein the bent valance is placed in a shipping box, thereby providing an easily shipped seamless and continuous valance;

a top bracket having a socket;

wherein the clip feature is configured to fit within the socket in the top bracket and to be frictionally held within the socket;

wherein the clip feature is configured to be removed from the socket by pulling the valance out of the socket.

12. A valance system, comprising:

a valance:

the valance extending a length between opposing ends;

the valance extending a height between an upper end and a lower end;

the valance having a clip feature extending outward from a rearward side and angled so that the clip extends downward as it extends outward from the rearward side;

the valance having at least one slot in its rearward side;

a pair of end caps:

the end caps extending a length between an inward end and an outward end;

the end caps including at least one tongue adjacent the inward end;

the at least one tongue configured to fit within the at least one slot in the valance;

the end caps having a hinge section;

wherein the pair of end caps is connected to the ends of the valance by connection of the at least one tongue of the end cap with the at least one slot of the valance;

wherein the hinge section is configured to facilitate bending of the end cap.

13. The valance system of claim 1, wherein the top bracket further includes a hook feature arranged on the rearward end of the top bracket, the hook feature forming a second socket configured to engage a nose of a wall bracket.

14. A valance system, comprising:

a valance extending a length between opposing ends;

the valance extending a height between an upper end and lower end;

the valance having a forward side and a rearward side;

the valance having a clip feature simultaneously extending outward and downward from the rearward side and extending between the opposing ends of the valance;

wherein the valance is bent;

wherein the bent valance is placed in a shipping box, thereby providing an easily shipped seamless and continuous valance;

a top bracket having an upper wall and a lower wall at the forward end, the upper wall and the lower wall forming a socket positioned in the forward end, the upper wall and the lower wall being angled so that the upper wall and the lower wall extends slightly downward as they extend rearward and wherein the lower wall includes a flange that extends slightly outward and downward and contacts the side of valance the below the clip feature, the socket being configured to receive the clip feature.

* * * * *